US008234730B2

(12) United States Patent
Skripps

(10) Patent No.: US 8,234,730 B2
(45) Date of Patent: Aug. 7, 2012

(54) BODY SUPPORT APPARATUS FOR SPINAL SURGERY

(75) Inventor: Thomas K. Skripps, Acton, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 364 days.

(21) Appl. No.: 12/576,524

(22) Filed: Oct. 9, 2009

(65) Prior Publication Data

US 2010/0024128 A1 Feb. 4, 2010

Related U.S. Application Data

(63) Continuation of application No. 11/402,327, filed on Apr. 11, 2006, now Pat. No. 7,600,281, which is a continuation-in-part of application No. 11/229,759, filed on Sep. 19, 2005, now Pat. No. 7,520,008.

(60) Provisional application No. 60/670,027, filed on Apr. 11, 2005, provisional application No. 60/670,040, filed on Apr. 11, 2005, provisional application No. 60/670,041, filed on Apr. 11, 2005, provisional application No. 60/720,598, filed on Sep. 26, 2005, provisional application No. 60/626,627, filed on Nov. 10, 2004.

(51) Int. Cl.
*A61G 13/12* (2006.01)

(52) U.S. Cl. ..... 5/621; 5/622

(58) Field of Classification Search ..... 5/621–624, 5/652, 631–632

See application file for complete search history.

(56) References Cited

U.S. PATENT DOCUMENTS

| | | | | |
|---|---|---|---|---|
| 870,324 | A | 11/1907 | Thomer | |
| 2,188,592 | A | 1/1940 | Cunningham | |
| 2,509,086 | A | 5/1950 | Eaton | |
| 3,042,025 | A | 7/1962 | Jackson | |
| 3,099,441 | A | 7/1963 | Ries | |
| 3,188,079 | A | 6/1965 | Boetcker et al. | |
| 3,811,140 | A | 5/1974 | Burpo | |
| 3,828,377 | A | 8/1974 | Fary, Sr. | |
| 3,873,081 | A | 3/1975 | Smith | |
| 3,946,452 | A | 3/1976 | Eary, Sr. | |
| 3,947,686 | A | 3/1976 | Cooper et al. | |
| 4,018,412 | A | 4/1977 | Kees, Jr. et al. | |
| 4,028,754 | A | 6/1977 | Eary, Sr. | |
| 4,054,282 | A | 10/1977 | Hamer | |
| 4,108,426 | A | 8/1978 | Lindstroem et al. | |
| 4,139,917 | A | 2/1979 | Fenwick | |
| 4,225,125 | A | 9/1980 | Lee | |
| 4,346,488 | A | 8/1982 | Eary, Sr. | |
| 4,398,707 | A * | 8/1983 | Cloward | 5/632 |
| 4,455,698 | A | 6/1984 | Eary, Sr. | |
| 4,474,364 | A | 10/1984 | Brendgord | |
| 4,484,911 | A | 11/1984 | Berlin et al. | |
| 4,520,800 | A | 6/1985 | Kowalski | |

(Continued)

FOREIGN PATENT DOCUMENTS

WO 2005/020819 A1 3/2005

*Primary Examiner* — Fredrick Conley

(74) *Attorney, Agent, or Firm* — Barnes & Thornburg LLP

(57) ABSTRACT

A body-support apparatus comprises a support assembly including two couplers and a cross-member and a plurality of body-support portions supported on the support assembly and moveable relative to the support assembly. The body-support apparatus is configured to be mounted on a patient-support apparatus which has generally parallel spaced apart members.

21 Claims, 20 Drawing Sheets

U.S. PATENT DOCUMENTS 4,526,355 A 7/1985 Moore et al.
4,527,787 A 7/1985 Collis, Jr.
4,531,247 A 7/1985 Eary, Sr.
4,549,501 A 10/1985 Anderson et al.
4,559,930 A 12/1985 Cobiski
4,579,111 A 4/1986 Ledesma
4,583,725 A 4/1986 Arnold
4,671,728 A 6/1987 Clark et al.
4,827,541 A 5/1989 Vollman et al.
4,840,362 A 6/1989 Bremer et al.
4,840,363 A 6/1989 McConnell
4,852,840 A 8/1989 Marks
4,866,796 A 9/1989 Robinson et al.
4,872,656 A 10/1989 Brendgord et al.
4,908,892 A 3/1990 Michelson
4,923,187 A 5/1990 Mombrinie
4,989,848 A 2/1991 Monroe
4,995,067 A 2/1991 Royster et al.
5,009,407 A 4/1991 Watanabe
5,014,375 A 5/1991 Coonrad et al.
5,088,706 A 2/1992 Jackson
5,131,106 A 7/1992 Jackson
5,163,193 A 11/1992 Whitmore
5,197,975 A 3/1993 Mombrinie
5,239,716 A 8/1993 Fisk
5,276,927 A 1/1994 Day
5,279,310 A 1/1994 Hsien
5,297,303 A 3/1994 Stafford et al.
5,297,539 A 3/1994 Liebl et al.
5,367,730 A 11/1994 Sher
5,444,882 A 8/1995 Andrews et al.
5,452,728 A 9/1995 Iams
5,489,258 A 2/1996 Wohnsen et al.
5,509,160 A 4/1996 Schubert
5,566,682 A 10/1996 Yavitz
5,575,027 A 11/1996 Mueller
5,584,302 A 12/1996 Sillaway et al.
5,613,254 A 3/1997 Clayman et al.
5,642,302 A 6/1997 Dumont et al.
5,658,315 A 8/1997 Lamb et al.
5,680,861 A 10/1997 Rohling
5,741,210 A 4/1998 Dobrovolny
5,758,374 A 6/1998 Ronci
5,758,647 A 6/1998 Cummins
5,926,876 A 7/1999 Haigh et al.
6,001,076 A 12/1999 Wilson et al.
6,003,174 A 12/1999 Kantrowitz et al.
6,047,420 A 4/2000 Priester, III et al.
6,065,165 A 5/2000 Delk et al.
6,076,525 A 6/2000 Hoffman
6,120,397 A 9/2000 Julian
6,154,901 A 12/2000 Carr
6,154,903 A 12/2000 Wai-Chung
6,260,220 B1 7/2001 Lamb et al.
6,324,710 B1 12/2001 Hernandez et al.
6,385,802 B1 5/2002 Roberts et al.
6,428,497 B1 8/2002 Crouch
6,490,737 B1 12/2002 Mazzei et al.
6,584,630 B1 7/2003 Dinkler
6,701,553 B1 3/2004 Hand et al.
6,718,581 B2 4/2004 Riach
6,754,923 B2 6/2004 Borders et al.
6,813,788 B2 11/2004 Dinkler et al.
7,600,281 B2 10/2009 Skripps
2002/0061225 A1 5/2002 Boucher et al.
2003/0167569 A1 9/2003 Newkirk et al.
2004/0123389 A1 7/2004 Boucher et al.
2004/0133979 A1 7/2004 Newkirk et al.
2004/0133983 A1 7/2004 Newkirk et al.
2006/0248650 A1 11/2006 Skripps

* cited by examiner

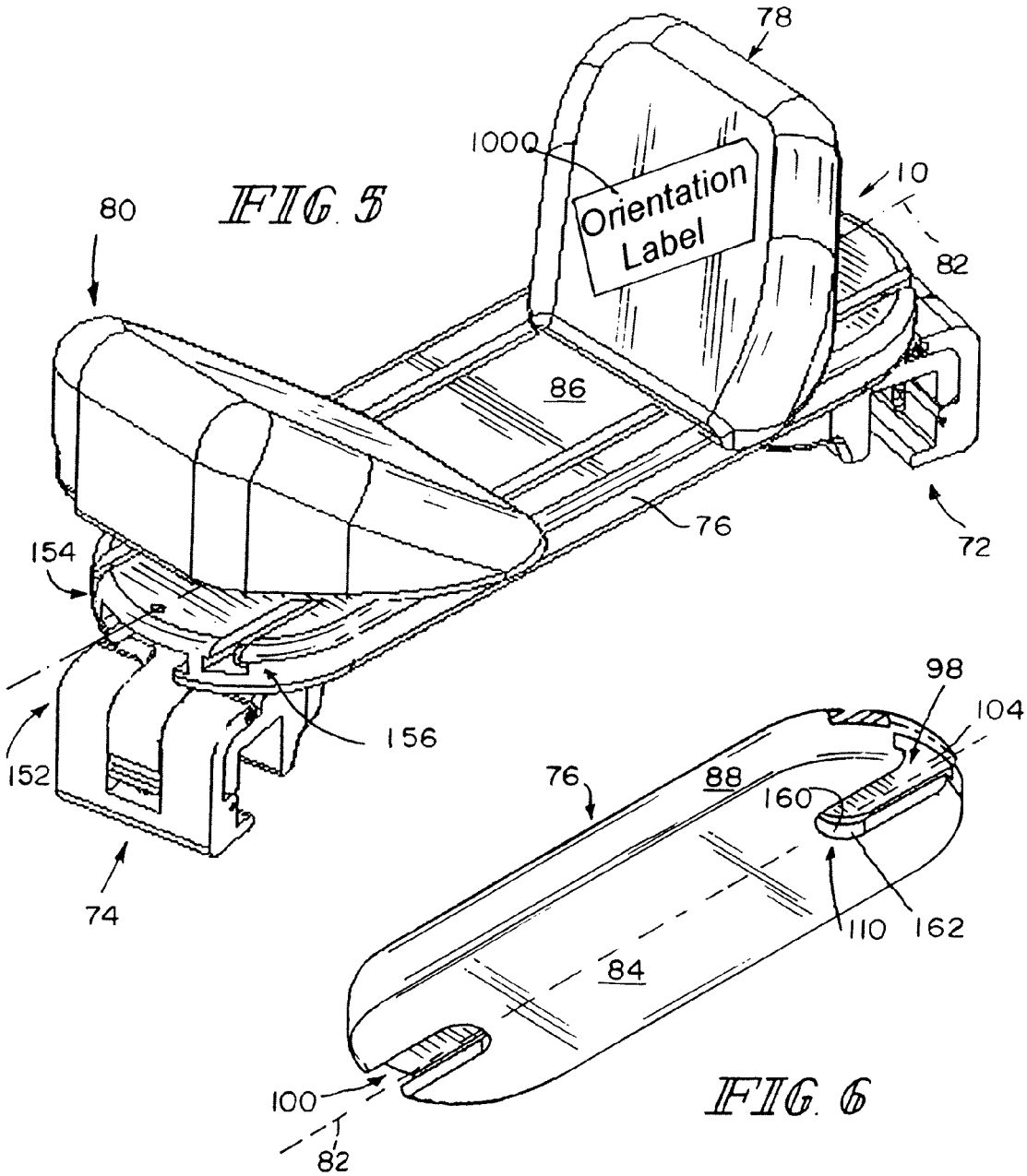
FIG. 5
FIG. 6
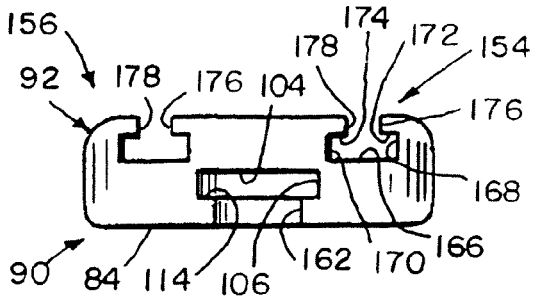
FIG. 7

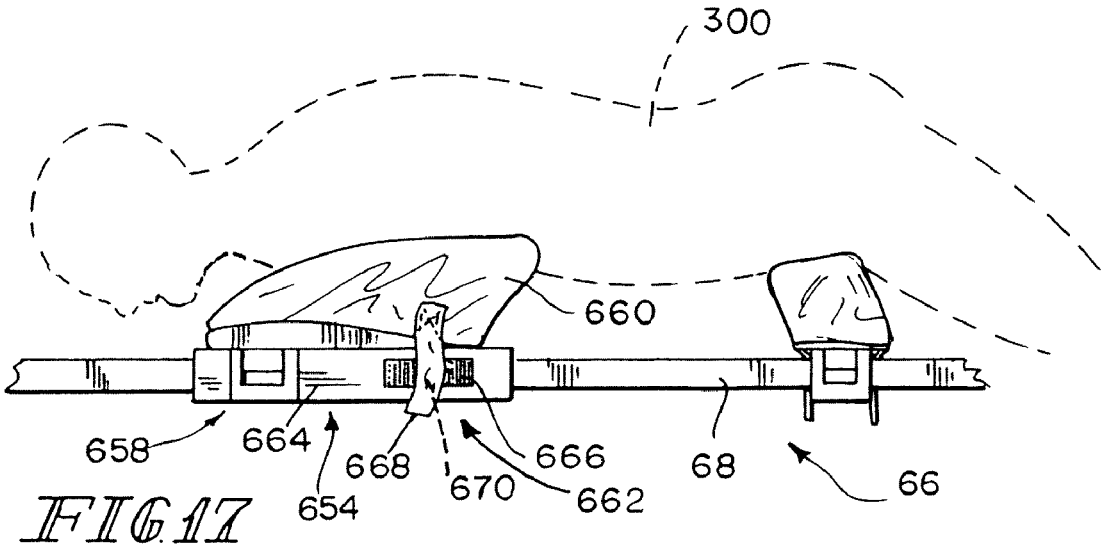
FIG. 17
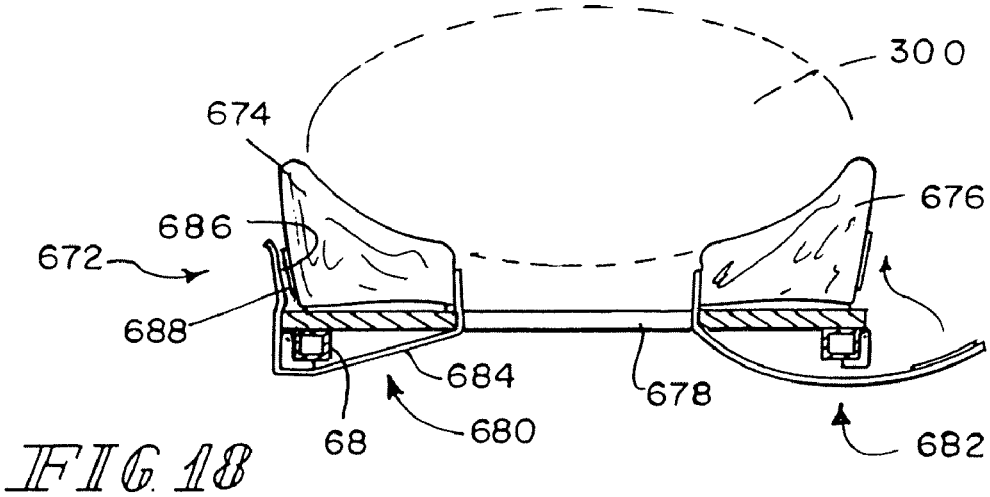
FIG. 18
FIG. 19
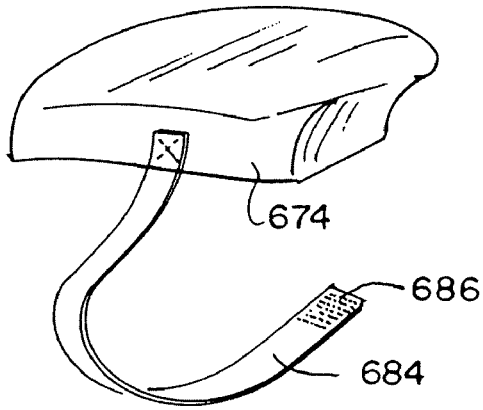

BODY SUPPORT APPARATUS FOR SPINAL SURGERY

This application is a continuation of U.S. application Ser. No. 11/402,327, which was filed Apr. 11, 2006, which issued on Oct. 13, 2009 as U.S. Pat. No. 7,600,281 and which claimed the benefit, under 35 U.S.C. §119(e), of U.S. Provisional Patent Application Nos. 60/670,027, 60/670,040, and 60/670,041 all three of which were filed Apr. 11, 2005; and of U.S. Provisional Patent Application No. 60/720,598 which was filed Sep. 26, 2005. U.S. application Ser. No. 11/402,327 is also a continuation-in-part of U.S. application Ser. No. 11/229,759 which was filed Sep. 19, 2005, which issued on Apr. 21, 2009 as U.S. Pat. No. 7,520,008, and which claimed the benefit, under 35 U.S.C. §119(e), of U.S. Provisional Patent Application No. 60/626,627 which was filed Nov. 10, 2004. U.S. Provisional Application Nos. 60/670,027; 60/670,040; 60/670,041; 60/720,598 and U.S. application Ser. No. 11/229,759 are hereby expressly incorporated by reference herein.

BACKGROUND OF THE INVENTION

The present disclosure relates to accessories that attach to surgical tables to support the body of a patient during surgery. More particularly, the present disclosure relates to patient support accessories that attach to surgical tables or surgical accessory frames and that are configured to engage the body of a patient during surgery, such as, for example, spinal surgery.

During some surgeries, such as orthopedic surgery, and particularly, spinal surgery, it is fairly important for x-ray images and/or fluoroscopic images to be taken of a patient due to the implantation of screws, rods, replacement discs, and the like, in very close proximity to critical nerves including the spinal cord. Surgical tables and accessories typically include metal components or inserts which produce unacceptable x-ray images.

Specialized orthopedic surgical tables have been developed for orthopedic surgery and a subset of these specialized orthopedic surgical tables, such as, for example, the "Jackson" table and the "Andrews" table, have been designed specifically for spinal surgery. These tables are configured with spaced apart members on which various body-support accessories for surgery are placed. Examples of the "Jackson" table may be found in U.S. Pat. Nos. 5,088,706; 5,131,106; 5,613,254; and 6,260,220. An example of the "Andrews" table may be found in U.S. Pat. No. 5,444,882.

Attempts have been made in the past to design substantially radiolucent table extensions that attach to standard surgical tables to support a patient during spinal surgery or other surgical procedures during which x-ray or fluoroscopic images are to be taken of the patient's upper body. See, for example, U.S. Pat. Nos. 4,995,067; 5,758,374; 6,003,174; 6,584,630; and 6,813,788. Each of the devices in the patents just listed include a table top or panel or similar such structure underlying the patient.

In some surgical procedures in which a patient is in a prone position, such as some spinal surgery procedures, it is desirable for the patient's abdomen to hang downwardly without obstruction so as not to be supported by an underlying table surface. In many situations is important to have a patient-support apparatus permitting flexure of a patient by a sufficient amount to place the lumbar region of the patient's spine in a more lordotic (i.e., more arched) or more kyphotic (i.e., flattened or hunched) position than when the patient is simply lying in a flat, prone position with the lumbar region of the patient's spine in its naturally arched position.

SUMMARY OF THE INVENTION

The present disclosure comprises one or more of the features recited in the appended claims and/or the following features which, alone or in any combination, may comprise patentable subject matter:

A body-support apparatus is configured to be secured to a patient-support apparatus having two generally parallel longitudinal members spaced apart such as a specialty surgical table. The body-support apparatus comprises body-support portions which are configured to be adjustable to support a patient thereon, especially, for example, a patient in a supine or prone position. The body-support portions may be shaped to engage a patient's hip area or chest area. The body-support portion may comprise radiolucent material such as roto-molded polyurethane.

The body-support apparatus may further comprise a support assembly including a cross-member configured to receive a body-support portion, a first coupler pivotably coupled to the cross-member, the first coupler configured to be releasably secured to a first member of the patient-support apparatus, and a second coupler coupled to the cross-member and pivotable and translatable relative thereto. The second coupler may be configured to be releasably secured to a second member of the patient support apparatus. In some embodiments, both the first and second couplers may be pivotable and translatable relative to the cross-member.

In some embodiments, the body-support apparatus may be mounted on the patient-support apparatus such that a longitudinal axis of the cross-member is oblique to both generally parallel members of the patient-support apparatus. The support assembly including the cross-member and first and second couplers may be adjusted such that the body-support apparatus may be mounted on patient-support apparatuses of different widths.

The body-support portion may be a single member mounted on the support assembly, the portion having two spaced apart portions extending vertically upwardly from the cross-member. The body-support portion may be mounted on the support assembly and moveable along a longitudinal axis of the cross-member to an infinite number of positions. In still other embodiments, a plurality of body-support portions may be mounted on the support assembly and moveable along a longitudinal axis of the cross-member to an infinite number of positions. When a plurality of body-support portions are mounted on the support assembly, they may be independently moveable to vary a spacing therebetween.

The body-support apparatus may further comprise a locking mechanism configured to secure a body-support portion at any of the infinite positions along the longitudinal axis of the cross-member. The locking mechanism may comprise an actuator engaging the body-support portion, a pressure plate engaged with the actuator and the cross-member and moveable between a first position wherein the body-support portion is free to move relative to the cross-member and a second position wherein the body-support portion is generally restrained from movement relative to the cross-member. In some embodiments, the actuator may be positioned on an outer portion of the support assembly to permit access and activation of the actuator when a patient is supported above the body-support portion. In some embodiments, the pressure plate may comprise a rubber portion configured to engage a surface of the cross-member. The rubber portion may have an irregular lower surface which deflects when the actuator is activated to the second position to increase the contact area between the rubber portion and the surface of the cross-member. In some embodiments, the body-support portion may be secured relative to the support assembly by a hook-and-loop fastener.

In some embodiments, the body-support apparatus may comprise a cushion supported on one of the body-support portions. The cushion may be configured to conform to the contours of the patient's body. In some embodiments, the body-support portion may have an upwardly facing surface which is convex.

A cover for a body-support portion or a cushion may comprise a main portion and a retainer secured about the perimeter of the main portion. The retainer may be configured to engage a body-support portion and retain the cover on the body-support portion. The main portion may comprise an outer surface and an inner surface. The outer surface may comprise water-based polyurethane foam. The inner surface may comprise a polyethylene fabric material. The retainer may be sewn to the main portion. The inner surface may be sewn to the outer surface. In some embodiments, the inner surface may be adhered to the outer surface.

In some embodiments, one or more of the components may comprise a radiolucent material. Structural components may comprise ABS (acrylontrile butadiene styrene) resin or an acetal resin such as Delrin®. Other radiolucent materials employed may include polyester, polyurethane, polyethylene, ultra-high-molecular-weight (UHMW) polyethylene, or other resin based materials. Fasteners may comprise an ultra-high-molecular-weight (UHMW) polyethylene. In some embodiments, the hook-and-loop fasteners may be omitted and a releasable fastening system having good holding power in shear a may be substituted. In some embodiments, for example, releasable adhesive systems may be employed in some embodiments.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which:

FIG. 5 is a perspective view of an adjustable body-support apparatus for spinal surgery;

FIG. 6 is a perspective view of a cross-member of the adjustable body-support of FIG. 5;

FIG. 7 is an end view of the cross-member of FIG. 6;

FIG. 17 is a side view another embodiment of a body-support apparatus adjustable to a plurality of positions to conform to the body contour of a patient in a prone position, the body-support apparatus including body-support portions supported on a cross-member and securable to the cross-member through a system of hook-and-loop-fasteners;

FIG. 18 is an end view of a body-support apparatus including two body-support portions adjustable laterally relative to one another;

FIG. 19 is a perspective view of a body-support portion of the body-support apparatus of FIG. 18;

DETAILED DESCRIPTION OF THE DRAWINGS

Figure 1:
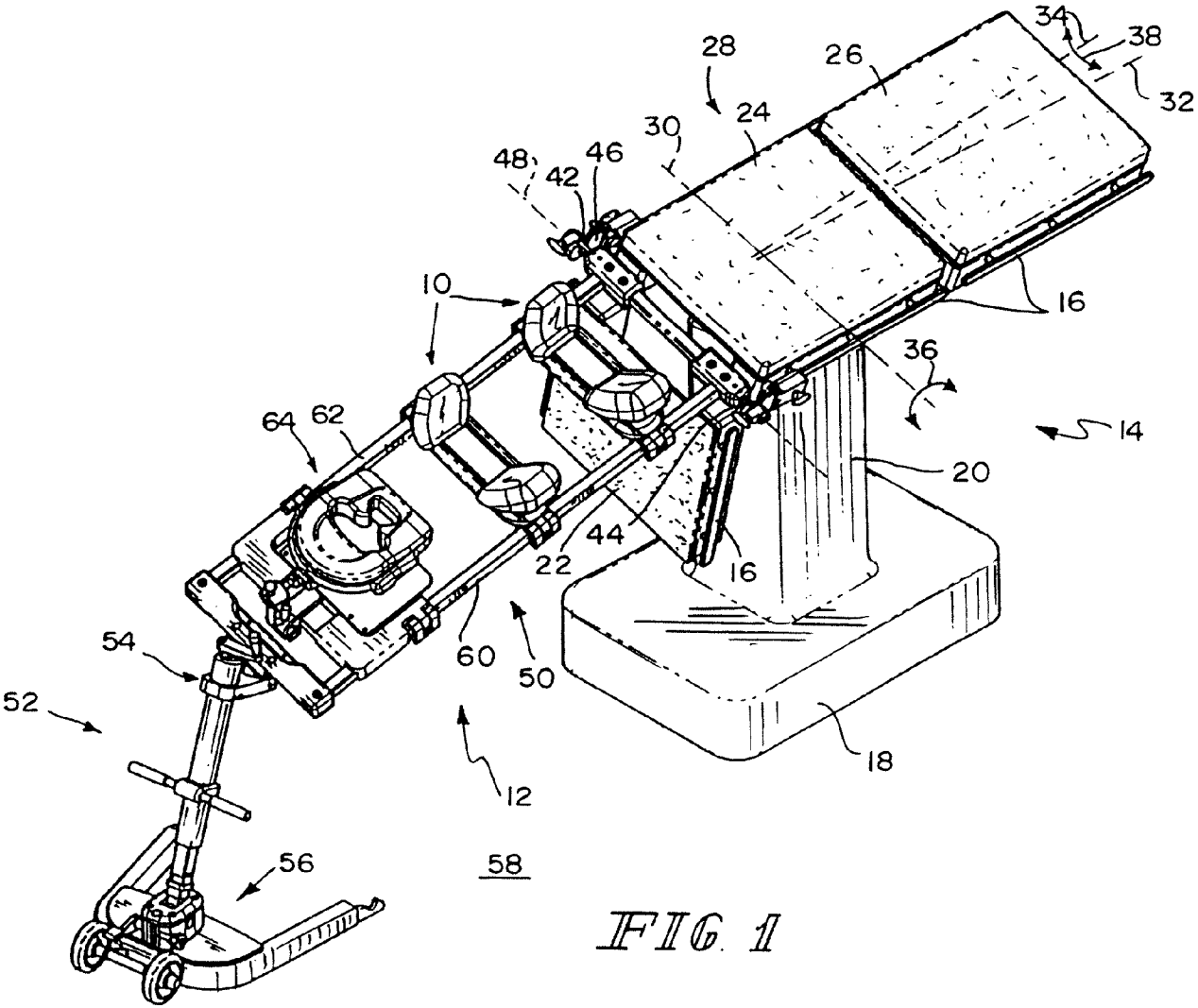
FIG. 1 is a perspective view of a surgical table with an accessory frame for spinal surgery engaged with the surgical table, the accessory frame including body-support apparatuses configured for spinal surgery secured to the accessory frame.

Two body-support apparatuses 10 are secured to an accessory frame 12 for spinal surgery as shown in FIG. 1. Accessory frame 12 is engaged with a surgical table 14 and extends therefrom. Accessory frame 12 and body-support apparatuses 10 are used with surgical table 14 to adapt surgical table 14 to support a patient for spinal surgery by providing access to a patient's back when the patient is in a supine or prone position supported on surgical table 14 and accessory frame 12. Body-support apparatus 10 is adjustable to conform to the contours of a patient's body and to support the patient during surgical procedures.

In the illustrative embodiment shown in FIG. 1, surgical table 14 has a base 18, pedestal 20, head section 22, seat section 24, and foot section 26. Head section 22 and foot section 26 are pivotably coupled to seat section 24 and pivotable relative thereto. Head section 22, seat section 24, and foot section 26 collectively form a patient support deck 28 which is configured to support a patient during typical surgical procedures. Each section 22, 24, 26 of patient support deck 28 includes two accessory rails 16 on opposite outward sides. Accessory rails 16 are of a standard size and are used during surgical procedures to support any of a number of different surgical accessories and patient support accessories. Patient support deck 28 is articulable relative to pedestal 20 in two axes 30 and 32. Relative to a longitudinal axis 34 of patient support deck 28 when the sections 22, 24 and 26 are in a flat orientation, patient support deck 28 is pivotable about axis 30 to change the pitch of support deck 28 as shown by arrow 36. Also, the roll of support deck 28 about axis 32 is adjustable as shown by arrow 38.

In use, accessory frame 12 is secured to accessory rails 16 of seat section 24 of surgical table 14. As shown in FIG. 1, head section 22 is articulated to an out-of-the-way position. Accessory frame 12 includes support bars 40 and 42 which are each received by couplers 44 and 46 respectively. Support bars 40 and 42 each have longitudinal lengths and are coincident with an axis 48. The engagement of support bars 40 and 42 with couplers 44 and 46 permits movement of support bars 40 and 42 relative to couplers 44 and 46 so that accessory frame 12 is free to pivot about axis 48 relative to surgical table 14. The coupling of accessory frame 12 to surgical table 14 and the details of couplers 44 and 46 and support bars 40 and 42 are provided in U.S. application Ser. No. 11/402,330 which published as U.S. Patent Application Publication No. 2006-0242765-A1 and which is titled "Accessory Frame For Spinal Surgery," which is filed concurrently herewith, and which is hereby expressly incorporated by reference herein.

Accessory frame 12 generally comprises a main portion 50 and an adjustable leg 52. Main portion is supported by surgical table 14 and adjustable leg 52. Adjustable leg 52 includes an upper coupler 54 and lower coupler 56 which permit main portion 50 to move relative to a floor 58 and follow movement of support deck 28 when support deck 28 is articulated relative to axes 30 and 32.

Main portion 50 comprises a first member 60 and a second member 62 which is laterally spaced from and substantially parallel to first member 60. Members 60 and 62 are substantially radiolucent such that they do not interfere with radioscopic and fluoroscopic procedures. Medical imaging such as radioscopy and fluoroscopy are regularly used during spinal surgery to confirm the positioning of the vertebrae of the patient and subsequent positioning of medical instruments and implants.

The spacing relative to one another and the cross-sectional shape and size of members 60 and 62 provide a standard structure to support various surgical accessories. For example, body-support apparatus 10 is configured to be supported on member 60 and 62 as shown in FIG. 1. A head support apparatus 64 for spinal surgery is also shown in FIG. 1 supported on members 60 and 62 of accessory frame 12. A further description of head support apparatus 64 is provided in U.S. application Ser. No. 11/402,332 which published as U.S. Patent Application Publication No. 2006-0253985-A1 and which is titled "Head Support Apparatus for Spinal Surgery," which is filed concurrently herewith, and which is hereby expressly incorporated by reference herein.

Figure 2:
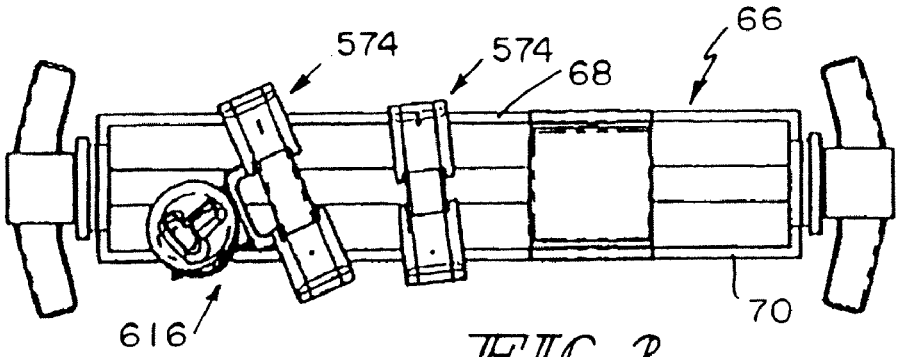
FIG. 2 is a top view of another surgical table having two parallel members extending between two extensible posts, the surgical table including body-support apparatuses for spinal surgery engaged with the parallel members.
Figure 3:
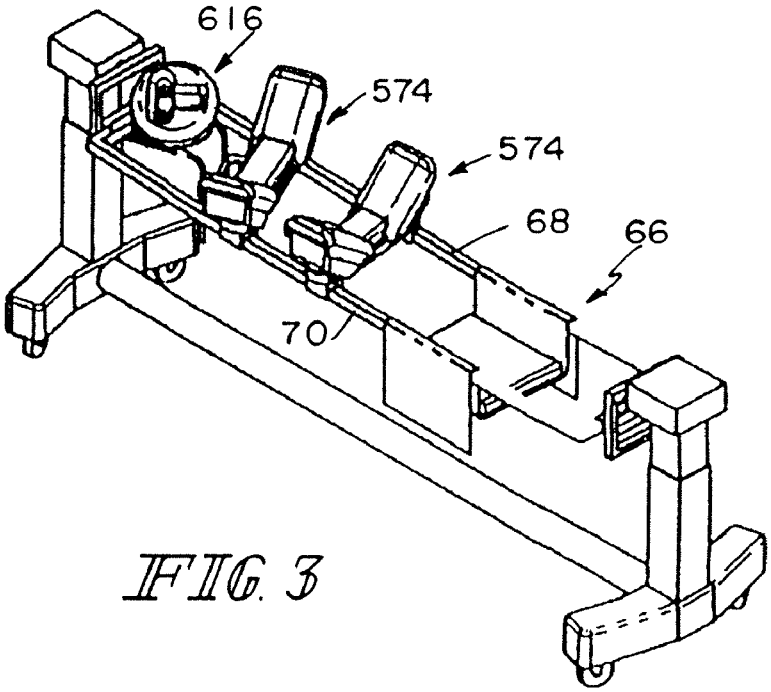
FIG. 3 is a perspective view of the surgical table and body-support apparatuses of FIG. 2.
Figure 4:
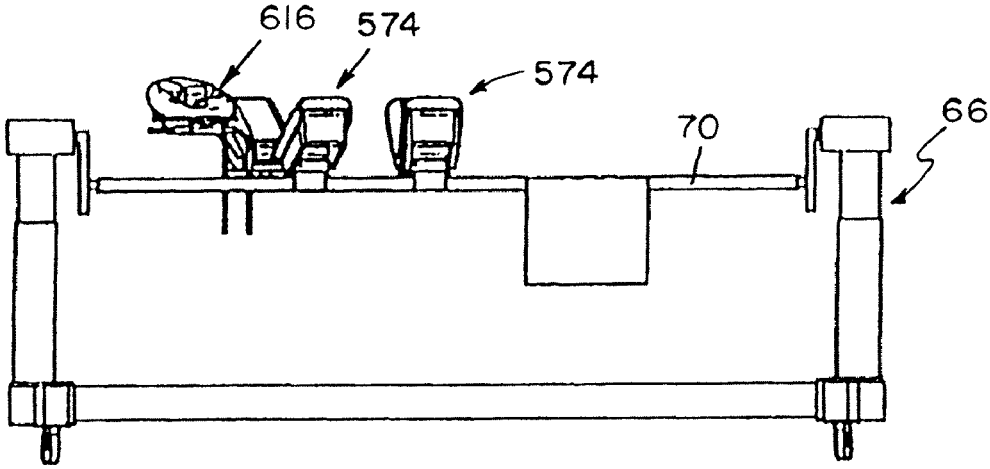
FIG. 4 is a side view of the surgical table and body-support apparatuses of FIG. 2.

It should be noted that while body-support apparatus 10 is configured to cooperate with accessory frame 12, there are other structures for support of surgical patients and particularly, spinal surgery patients, which the support apparatus 10 may cooperate with to provide support to the body of a patient in a supine or prone position during spinal surgery. For example, a specialty surgical table 66 is shown in FIGS. 2-4. Surgical table 66 includes two members 68 and 70 which are spaced apart and generally parallel, members 68 and 70 extending along the length of surgical table 66. This type of table is known in the art as a "Jackson Table" and the size and spacing of members 68 and 70 are standardized to permit the cooperation of multiple surgical accessories and supports to be mounted to members 68 and 70. It should be understood that it is within the spirit and scope of this disclosure that the body-support apparatus 10 and other embodiments of body-support apparatuses disclosed herein may be configured to cooperate with the accessory frame 12, a "Jackson Table," or other patient-support apparatus which comprises spaced apart, generally parallel, longitudinal members.

In a first embodiment of the present disclosure, body-support apparatus 10 includes two couplers 72 and 74, a cross-member 76, a first body-support portion 78 and a second body-support portion 80 as shown in FIG. 5. Couplers 72 and 74 are coupled to cross-member 76 such that couplers 72 and 74 are each pivotable relative to cross-member 76. Additionally, couplers 72 and 74 each translate parallel to a longitudinal axis 82 of cross-member 76. Couplers 72 and 74 are configured to engage members 60 and 62 of accessory frame 12 and secure body-support apparatus 10 to accessory frame 12. In the illustrative embodiment of FIG. 5, couplers 72 and 74 are configured to prevent movement of body-support apparatus 10 along the length of members 60 and 62. However, cross-member 76 has limited lateral movement relative to accessory frame 12.

Various components of body-support apparatus 10 and other embodiments of body support apparatuses discussed herein may comprise radiolucent materials. Structural components may comprise ABS (acrylontrile butadiene styrene) resin or an acetal resin such as Delrin®. Other radiolucent materials employed may include polyester, polyurethane, polyethylene, ultra-high-molecular-weight (UHMW) polyethylene, or other resin based materials. For example, ultra-high-molecular-weight (UHMW) polyethylene is particularly suited as a material for radiolucent fasteners. ABS has good strength-to-weight properties and is suited as a structural material used in applications such as cross-member 76. It is within the spirit and scope of this disclosure that the various structures described herein utilize one or more radiolucent materials suited for the particular application of the structure. Disclosure of a particular material for a structure should not be construed to limiting the structure to that material if other suitable materials may be substituted in the application. Also, while reference is made here in to systems of hook-and-loop fasteners, it should be understood that any of a number of releasable fastening systems are available which have good holding power in shear and which may be substituted for hook-and-loop fasteners. For example, releasable adhesive systems may be employed in some embodiments.

Referring to FIGS. 6 and 7, cross-member 76 has a lower surface 84 which is downwardly facing when body-support apparatus 10 is secured with accessory frame 12. Similarly, an upper surface 86 is upwardly facing when body-support apparatus 10 is secured to accessory frame 12. A perimeter surface 88 circumscribes the perimeter of cross-member 76 connecting lower surface 84 and upper surface 86. When viewed along the longitudinal axis 82 of cross-member 76, the transition from perimeter surface 88 to lower surface 84 is radiused as depicted by arrow 90. The transition from perimeter surface 88 to upper surface 86 is also radiused as depicted by arrow 92, but radius 92 is somewhat larger than radius 90. Radiuses 90 and 92 provide relief in the transition between surfaces and eliminate sharp edges about the perimeter of cross-member 76.

When viewing surface 84 perpendicular to axis 82, cross-member 76 has an elongated oval shape with semi-circular end portions 94 and 96. End portions 94 and 96 have a semi-circular shape so as to provide clearance for the couplers 72 and 74 to pivot relative to cross-member 76. In the illustrative embodiment of FIG. 5, couplers 72 and 74 pivot relative to cross-member 76 and translate relative to cross-member 76 along longitudinal axis 82. Translation of couplers 72 and 74 relative to cross-member 76 is facilitated by symmetrical slots 98 and 100. For simplicity, the relative discussion of the structure of slots 98 and 100 will be addressed in a description of slot 98. Slot 100 has identical features formed cross-section 76 but is formed as a mirror image.

Referring now to FIG. 7, slot 98 has a t-shaped aperture 102 formed in perimeter 88 and radius surface 90 when viewed along longitudinal axis 82. T-shaped aperture 102 is configured to receive a retaining portion 108 of a stud 118 (best seen in FIG. 10) of coupler 72 and allow coupler 72 to slide freely in slot 98 parallel to axis 82, while retaining coupler 72 so as to prevent movement perpendicular to axis 82. Slot 98 is bounded by a generally planar surface 104 which is substantially parallel to lower surface 84 and forms an upper boundary for slot 98 when body-support apparatus 10 is secured to frame apparatus 12. Another surface 106 is substantially perpendicular to planar surface 104 and traverses slot 98 intersecting perimeter surface 88. Surface 106 has a semi-circular portion 110 inward from the semi-circular end portion 94 of cross-member 76 and is configured to permit retaining portion 108 to be received fully without interference.

Another planar surface 114 is substantially parallel to planar surface 104 and is positioned in an opposing orientation to planar surface 104. Planar surface 114 engages with a surface 116 of the retaining portion 108 of stud 118 (as seen in FIG.

10). The engagement of planar surface 114 with surface 116 results in limiting movement of coupler 74 in a vertical direction when body-support apparatus 10 is secured to accessory frame 12. Slot 98 is further defined by another aperture 118 in lower surface 84. Aperture 118 is formed by the intersection of a surface 162, which is generally perpendicular to planar surface 104, with planar surface 114. Aperture 118 has a profile which is generally parallel to surface 106 but smaller such that surface 106 defines an inner space for retaining portion 108 of stud 112 while aperture 118 is configured to accommodate a stem 120 of stud 112. Thus, the larger portion of t-shaped slot 98 is configured to receive retaining portion 108 of stud 112 and surface 162 is configured to accommodate stem 120 when stud 112 is moved in slot 98 to be fully inward from semi-circular end portion 94. Stud 112 has a longitudinal axis 122. When retained within slot 98 stud 112 is free to pivot about axis 122, but is constrained from moving along axis 122. When body-support apparatus 10 is assembled, axis 122 of stud 112 is maintained in a generally perpendicular orientation to longitudinal axis 34 of cross-member 76.

Figure 10:
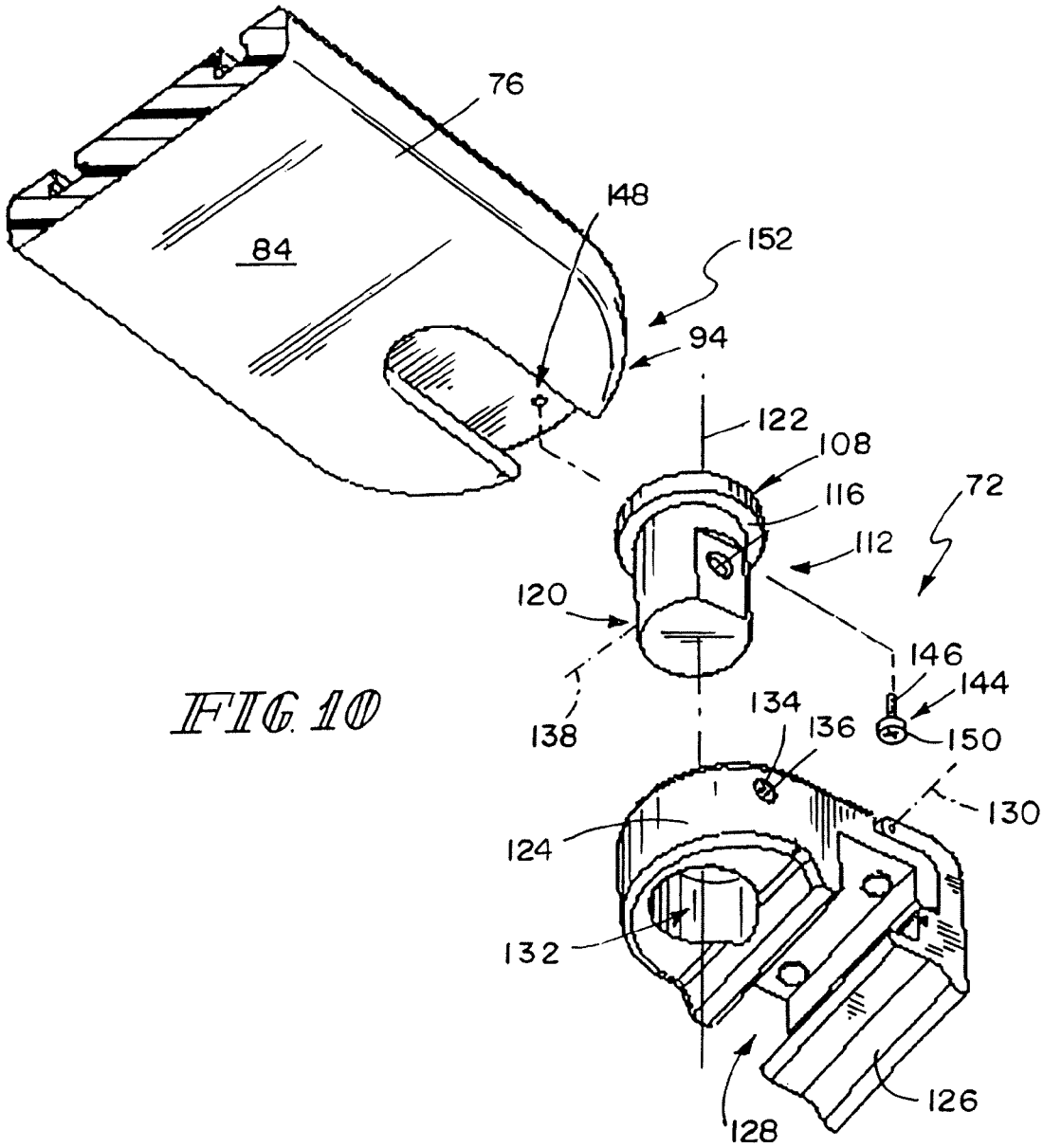
FIG. 10 is an exploded perspective view of a portion of the body-support apparatus of FIG. 5 showing the assembly of a coupler to the cross-member.

In the illustrative embodiment of FIG. 10, coupler 74 is a clamp comprising stud 112, a body portion 124 secured to stud 112, and a gripper 126 which is pivotably coupled to body portion 124. Generally, body portion 124 includes a channel 128 which engages with an upper surface of one of the members 60, 62 of accessory frame 12 when the body-support apparatus 10 is secured to the accessory frame 12. Gripper 126 pivots relative to body portion 124 about a pivot axis 130 between a disengaged position and an engaged position wherein gripper 126 is positioned to retain coupler 74 on one of the members 60, 62 so that body-support apparatus 10 is secured to accessory frame 12.

Stem 120 of stud 112 has a generally cylindrical shape with a circular cross-section when viewed along longitudinal axis 122. Stem 120 is sized to be received in a cylindrical through-hole 132 formed in body portion 124. Cylindrical through-hole 132 defines an axis 140. Stud 112 is secured to body portion 124 by a fastener 134 which passes through a cross-hole 136 in body portion 124. Cross-hole 136 defines a central axis 138 which is perpendicular to axis 140 of cylindrical through-hole 132. Fastener 134 has a threaded body having male threads formed on the fastener and passes through cross-hole 136 and engages female threads formed in wall of a hole 142 defined in the stem 120 of stud 112. When assembled, fastener 134 secures stud 112 to body portion 124 of coupler 74 such that stud 112 is fixed relative to body portion 124.

Once assembled, coupler 74 is engaged with cross-member 76 through the engagement of retaining portion 108 with slot 98. Retaining portion 108 is retained within slot 98 by a fastener 144 which includes a threaded portion 146 having male threads which are engaged with female threads formed in the wall of a hole 148 in cross-member 76. Fastener 144 includes a head 150 which serves to impede the movement of coupler 74 within slot 98 along axis 82. Coupler 74 is therefore free to pivot within slot 98 about longitudinal axis 122 of stud 112 and is free to translate along axis 82. As discussed above, coupler 72 is identical to coupler 74 and is engaged with slot 100 of cross-member 76 and is free to pivot and translate relative to cross-member 76.

Translation of couplers 72 and 74 relative to cross-member 76 permits body-support apparatus 10 to be secured to accessory frames and surgical tables having differing widths. For example, it is known that in some cases patient-support apparatuses have members which are spaced apart by about 14 inches. In other cases, patient-support apparatuses have members which are spaced apart by about 18 inches. The translation of couplers 72 and 74 permit the body-support apparatus 10 to be secured to patient-support apparatuses having any of a number of different widths. Additionally, the pivoting action of couplers 72 and 74 combined with translation, allow the body-support apparatus 10 to be positioned on a patient-support apparatus such as surgical table 66 or accessory frame 12 in an orientation such that the longitudinal axis 82 of cross-member 76 is oblique to the longitudinal axis of the patient-support apparatus. A more thorough discussion of couplers 72 and 74 is provided in U.S. application Ser. No. 11/402,331 which published as U.S. Patent Application Publication No. 2006-0255220-A1 and which is titled "Accessory Rail Clamp with Latch and Lock Mechanisms," which is filed concurrently herewith, and which is hereby expressly incorporated by reference herein.

Referring again to FIGS. 5-7, two generally parallel slots 154 and 156 traverse the longitudinal length of cross-member 76. Each slot 154, 156 has a t-shaped cross-section when viewed along longitudinal axis 82. Slots 154 and 156 function in a manner similar to slots 98 and 100 by providing retention of heads 162 of fasteners 160 which are coupled to a main portion 164 of body-support portions 78 and 80 within slots 154 and 156 so that body-support portions 78 and 80 are free to move parallel to axis 82 but are retained in the direction perpendicular to axis 82.

Slot 154 includes a lower planar surface 166 which is generally parallel to upper surface 86 of cross-member 76. Two side wall surfaces 168 and 170 are generally perpendicular to surface 166 and extend vertically therefrom. Side wall surface 168 intersects a generally planar surface 172 which is generally parallel to surface 166 and is facing surface 166. Similarly, a generally planar surface 174 is generally parallel to surface 166 and intersects side wall surface 170. Surface 172 and 174 are configured to oppose vertical movement of fasteners 160 by retaining heads 162 within the expanded portion of t-slot 154. Planar surface 172 intersects yet another surface 176 which is generally perpendicular to surface 172 and upper surface 86 of cross-member 76. Also, another surface 178 intersects planar surface 174 and upper surface 86. Surface 178 is generally perpendicular to surface 174 and 86.

Figure 12:
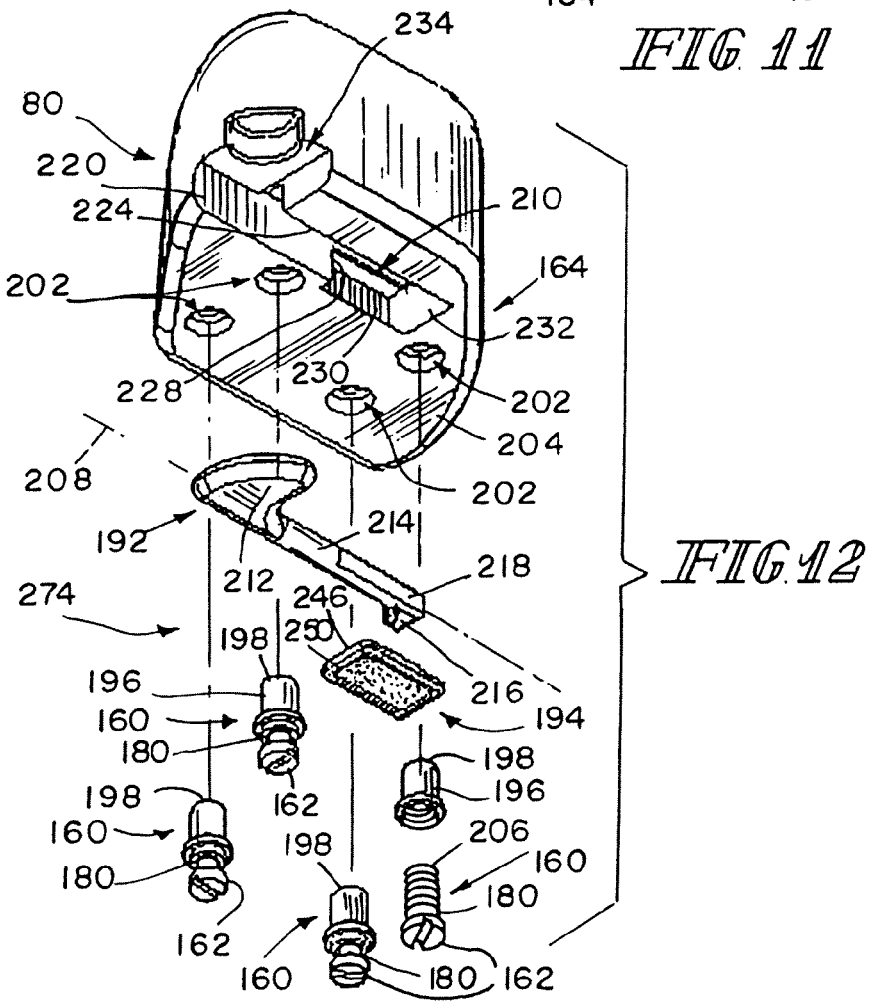
FIG. 12 is an exploded perspective view of the bottom of a body-support portion including an actuator and a pressure pad for securing the body-support portion relative to the cross-member.

Surfaces 176 and 178 define an opening therebetween which is configured to accommodate a stem 180 of fastener 160 (best seen in FIG. 12) as head 162 of fastener 160 traverses in slot 154. Stems 180 provide support for main body 164 of body-support portions 78 and 80 when fasteners 160 are engaged in slots 154 and 156. The size of stem 180 and head 162 is configured to provide free movement of fastener 160 along slots 154 and 156.

Figure 11:
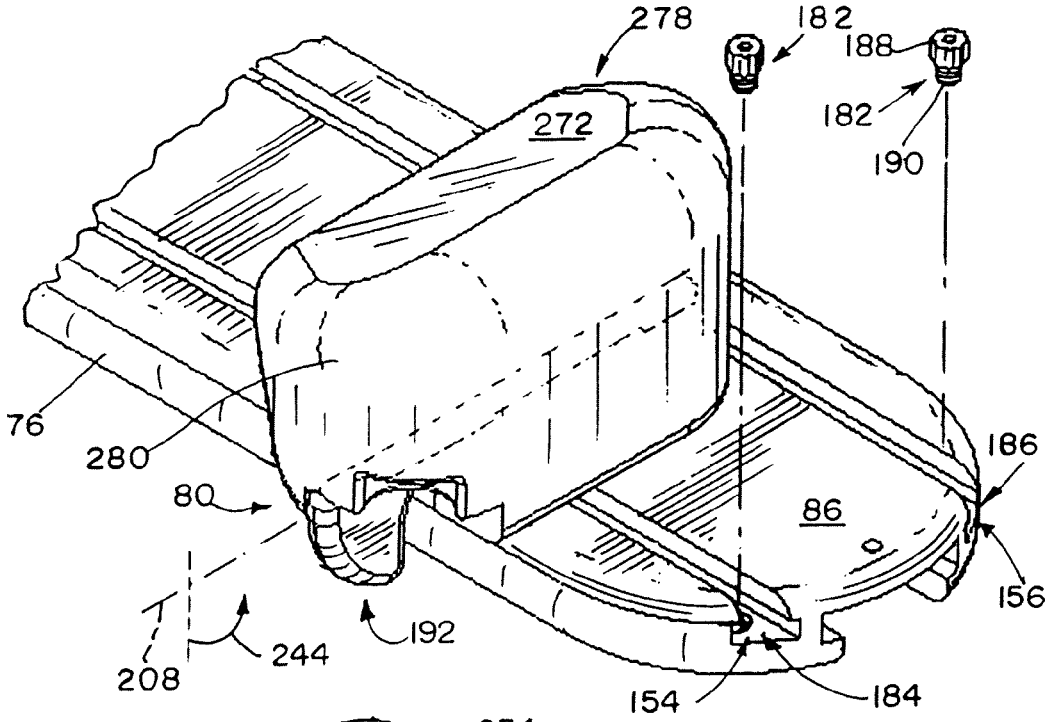
FIG. 11 is an exploded perspective view of a portion of the body-support apparatus of FIG. 5 showing the assembly of stops in channels to limit the travel of a body-support portion relative to the cross-member.

Referring to FIG. 11, support 80 is shown mounted to cross-member 76. While not shown in FIG. 11, it should be understood that support 78 is mounted on cross-member 76 in a similar manner. Support 80 is precluded from exiting slots 154 and 156 by fasteners 182 which are secured to cross-member 76. Fastener 182 includes a head 188 and a threaded shaft 190. Threaded shaft includes male threads which engage female threads formed in the wall of a hole 184 intersecting surface 166 of slot 154 and a hole 186 formed in surface 168 of slot 156. Heads 188 of fasteners 182 engage heads 162 of fasteners 160 to prevent supports 78 and 80 from being removed from cross-member 76. Supports 78 and 80 are free to translate along longitudinal axis 82 of cross-member 76 inward of fasteners 182.

As has been described, cross-member 76 and couplers 72 and 74 cooperate to provide a support assembly 152 to which various body-support portions may be mounted. In the illustrative embodiment of FIG. 5, body-support apparatus 10 body-support portions 78 and 80 which are supported on cross-member 76 and move parallel to the longitudinal axis 82 of cross-member 76 to vary the spacing therebetween. It should be understood that support assembly 152 is configured to support any of a number of body-support portions. Various embodiments of body-support apparatuses will be discussed below and each of the body-support portions may be adapted to be mounted on and supported by assembly 152. The body-support portions 78 and 80 of the illustrative embodiment of FIG. 5 are similarly configured but formed in mirror images as left and right hand versions. Body-support portion 80 will be discussed in detail but the features on body-support portion 78 are substantially similar. As shown in FIG. 5, in some embodiments, an orientation label 1000 is adhered to a body-support portion such as body-support portion 80. Label 1000 gives indicia of how to correctly orient the body-support apparatus on a patient-support apparatus.

Referring now to FIGS. 11-13*b*, body-support portion 80 comprises main portion 164, an actuator 192, a pressure plate 194, fasteners 160, and inserts 196. The main portion 64 comprises a polyurethane material which has sufficient stiffness to provide support for a portion of a patient's body-supported thereon. Inserts 196 comprise ultra-high-molecular-weight (UHMW) polyethylene and are coupled to main portion 64 so as to provide a mechanical interface for fasteners 160. Inserts 196 have a generally cylindrical shape with a blind end 198 and an open end 200. The internal surface of inserts 196 is formed to provide female threads which are configured to engage male threads on the shaft of fastener 160. Thus, inserts 196 provide an interface between fasteners 160 and main portion 164 of body-support portion 80. Assembly of inserts 196 to main portion 164 permits the control of the depth of fasteners 160 to assure that all fasteners 160 are in a generally similar position when body-support portions 78 and 80 are engaged with cross-member 76.

Inserts 196 are coupled to main portion 164 when main portion 164 is formed through a molding process. In some embodiments, inserts 196 may be coupled to main portion 164 by an adhesive. In still other embodiments, inserts 196 may be configured to include external ribs which resist rotation of inserts 196 when they are engaged with main portion 164. Main portion 164 includes four holes 202 formed in a lower surface 204. Holes 202 receive inserts 196. It should be understood that in some embodiments inserts 196 may be omitted and fasteners 160 may be engaged with holes 202 directly. When fasteners 160 are engaged with inserts 196, and end 206 of fastener 160 engages with the blind end 198 of insert 196. The engagement of end 206 to end 198 limits the travel of fastener 160 and establishes an appropriate extension of stem 180 and head 162 of fastener 160 such that head 162 he is received in slots 154 and 156 and body-support portion 80 is free to translate relative to cross-member 76. Fasteners 160 also comprise ultra-high-molecular-weight (UHMW) polyethylene.

A locking mechanism 274 comprises actuator 192 and pressure plate 194 which cooperate to permit a user to position body-support portion 80 along the longitudinal axis 82 of cross-member 76 and to secure body-support portion 80 from movement relative thereto. Actuator 192 comprises acetal resin and generally rotates about a longitudinal axis 208 between an engaged position wherein pressure plate 194 engages with surface 86 of cross-member 76 to secure body-support portion 80 in position and a disengaged position wherein pressure plate 194 is positioned such that body-support portion 80 is free to move relative to cross-member 76. Main portion 64 of body-support portion 80 includes a complex cavity 210 formed in lower surface 204 which is configured to receive actuator 192 and pressure pad 194 and allow for movement of actuator 192 and pressure pad 194 between engaged and disengaged positions.

Figure 13:
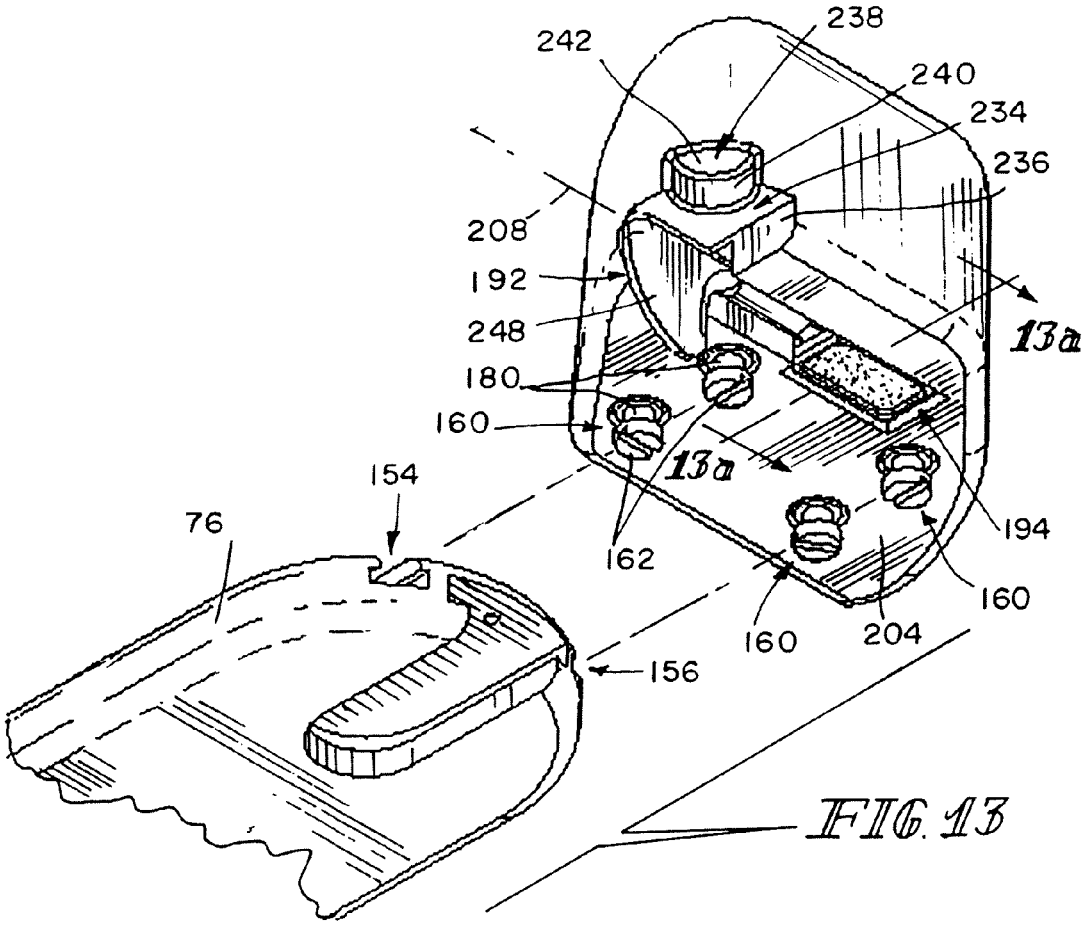
FIG. 13 is a perspective view of the bottom of a body-support portion with an actuator and a pressure pad secured thereto, the body-support portion positioned to be engaged with a cross-member.
Figure 13A:
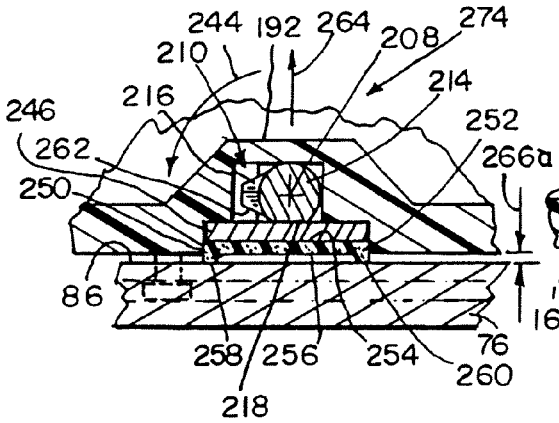
FIG. 13*a* is a cross-sectional view of the body-support portion of FIG. 13 taken along lines 13*a*-13*a*, the cross-sectional view showing the actuator positioned so that the pressure pad is disengaged and the body-support portion is free to move relative to the cross-member.
Figure 13B:
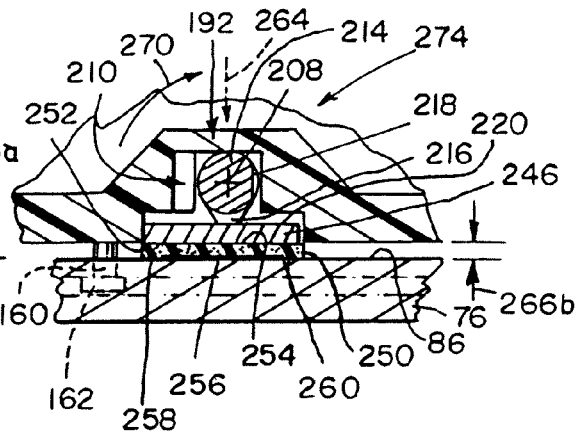
FIG. 13*b* is a cross-sectional view similar to FIG. 13*a*, with the actuator positioned such that the pressure pad is engaged and the body-support portion is precluded from moving relative to the cross-member.

Actuator 192 includes a handle 212, a shaft 214, and cam 216. Handle 212 is shaped such that a user may engage handle 212 to rotate actuator 192 about axis 208. Axis 208 coincides with the central axis of shaft 214. Cam 216 is coupled to shaft 214. Shaft 214 has a generally circular cross-section when viewed along the axis 208, and has a generally planar surface 218 configured to engage an upper surface 220 of pressure plate 194. Surface 218 engages upper surface 220 of pressure plate 194 when actuator 192 is rotated to a disengaged position as shown in FIGS. 13 and 13*a*. When actuator 192 is rotated about axis 208 to the engaged position as shown in FIG. 13*b*, cam 216 engages with surface 220 urging pressure plate 194 against upper surface 86 of cross-member 76.

Cavity 210 formed in main portion 164 includes a first surface 220 which is generally perpendicular to lower surface 204 and intersects a perimeter surface 222 of body-support portion 80. Another surface 224 is generally parallel to surface 220 and is spaced apart from surface 220 to create an opening therebetween which is sized to receive shaft 214 of actuator 192. Cavity 210 further includes an upper surface 226 which is generally parallel to surface 204 in spaced vertically therefrom to define an upper boundary of cavity 210 when body-support portion 80 is an upright position. Surface 220 intersects yet another surface 228 which is generally perpendicular to surfaces 204 and 226 and intersects both surfaces 204 and 226. Still yet another surface 230 is generally perpendicular to surfaces 204 and 226 and intersects surfaces 204, 226 and 228. Finally, surface 232 is generally perpendicular to and intersects surfaces 204 and 226, and is parallel to and intersects surfaces 224 and 230. Thus, surfaces 228, 230 and 232 to form a space in cavity 210 which is configured to receive pressure pad 194.

In addition to cavity 210, body-support portion 80 includes a relief area 234 which is sized to accommodate handle 212 of actuator 192 when actuator 192 is in an engaged position. Release area 234 is defined by surface 226 and a surface 236 which is generally perpendicular to surfaces 204 and 226 and intersects perimeter surface 222 hand surface 224 as well as surfaces 204 and 226. Yet another relief area 238 is positioned to provide a user access to a surface 248 of handle 212 when actuator 192 is in a disengaged position. Release area 238 is bounded by a semicircular surface 240 which is generally perpendicular to surface 226 and intersects surface 226. Surface 240 intersects a surface 242 which is generally parallel to surface 226 and spaced vertically above surface 226 sized to allow a user to insert a finger between surface 242 and surface 248 of actuator 192. It should be understood that while relief area 238 is sized to permit a user to insert a finger, any of a number of instruments may be inserted into relief area 238 by a user to actuate actuator 192.

Referring now to FIG. 11, actuator 192 is shown in the disengaged position such that surface 218 is engaged with surface 220 of pressure plate 194. When actuator 192 is pivoted in the direction of arrow 244 cam 216 engages surface 220 of pressure plate 194 and urges pressure plate 194 against surface 86 of cross-member 76. Pressure plate 194 comprises an upper member 246 and a lower member 250. Member 246 comprises a rigid material, ABS, which receives the point load of cam 216 on to surface 220 and distributes the force across a lower surface 252. The force exerted by cam 216 on surface 220 is thereby distributed to an upper surface 254 of lower member 250. Lower member 254 further includes a lower surface 256 and two protrusions 258 and 260 which extend from lower surface 256 and extend along the longitudinal length of lower member 250 along the longitudinal sides of lower member 250. Lower member 250 is adhered to upper member 248 by an adhesive. Lower member 250 comprises a urethane material which has a high coefficient of friction and the forms under pressure to provide a sufficient interface with cross-member 76 to secure body-support portion 80 in position relative to cross-member 76.

Referring now to FIGS. 13*a* and 13*b*, the action of actuator 192 and pressure plate 194 will be described in detail. FIG. 13*a* shows the positioning of actuator 192 within cavity 210 when actuator 194 is in a disengaged position. Surface 218 of shaft 214 is fully engaged with upper surface 220 of pressure plate 194. In this position, pressure plate 194 has sufficient clearance such that protrusions 258 and 260 act as springs to maintain lower surface 256 spaced apart from upper surface 86 of cross-member 76. In this disengaged position body-support portion 80 main body 164 rides on protrusions 258 and 260 and are thereby free to move relative to cross-member 76.

When actuator 192 is rotated in the direction of angle 244 actuator shaft 214 is rotated about axis 208 such that surface 218 disengages upper surface 220 and a cam surface 262 engages surface 220. Continued rotation in the direction of arrow 244 about axis 208 results in the urging of pressure plate 194 downwardly. The outer surface of shaft 214 maintains contact with surface 226 of cavity 210, but the interference between actuator 216 and pressure plate 194 creates a force in the direction of arrow 264. Once actuator 192 is rotated a full 90° in the direction of arrow 244, pressure plate 194 is urged away from surface 226 such that lower member 250 is deformed as shown in FIG. 13*b*. In addition, main portion 164 is urged away from cross-member 76 so that any play in the relationship between heads 162 of fasteners 160 in slots 154 and 156 is removed. As shown in FIG. 13*a*, a displacement 266*a* between main portion 164 and cross-member 76 is determined by the extent to which protrusions 258 and 260 urge pressure plate 194 and shaft 214 upwardly to engage surface 226. It can be seen in FIG. 13*b* that displacement 266*b* is greater than displacement 266*a*. The displacement 266 is increased due to the deformation of protrusions 258 and 260 and the removal of any play between heads 162 and slots 154 and 156. Thus, FIG. 13*b* shows the interaction of actuator 192 and pressure plate 194 and engaged position. In this position, a surface 268 of can 216 is engaged with surface 220 of upper member 246 of pressure plate 194.

Rotation of actuator 192 about axis 208 in the direction of arrow 270 results in the release of the force depicted by arrow 264 as indicated by the dashed line version of arrow 264 in FIG. 13*b*. Thus, to disengage pressure plate 194 from cross-member 76, actuator 192 is rotated 90° in the direction of arrow 270 about axis 208. Actuator 192 and pressure plate 194 thereby cooperate to create a locking mechanism 274 which serves to provide a simple way for a user to position a body-support portion such as body-support portion 82 any of a number of positions along the longitudinal length of cross-member 76 and secure the body-support portion in a desired position.

Support portion 82 is one of several embodiments of body-support portions which will be discussed in further detail below. Each embodiment of body-support portion is configured to interface with the contours of a patient's body so as to provide support during surgery. In many cases, a patient must be supported in a supine or prone position. Risks associated with extended supine or prone position are complicated by the fact that the patient is typically under general anesthesia and unable to communicate with a caregiver. Body-support portion 82 is shaped to be positioned to support the patient without obstructing blood flow through blood vessels during the surgery. It is know that supporting a patient at the pelvis and shoulders is effective in reducing the risk of injury. In addition, it is beneficial to have clearance for the abdomen to move during surgery so that respiration is easier for the patient and so that blood is not forced into the spinal surgery site.

Referring to FIG. 11, body-support portion 80 comprises perimeter surface 222 and an upper surface 272. Perimeter surface 222 extends vertically from an intersection with lower surface 204 about the perimeter of body-support portion 80. Perimeter surface 222 then transitions into upper surface 272. Upper surface 272 is a generally planar surface positioned oblique to lower surface 204 such that upper surface 272 is spaced at a greater vertical distance from lower surface 204 at the outward side 276 of body-support portion 80. Upper surface 272 has a rounded end 278 a generally triangularly-shaped end 280. End 280 is intersected by perimeter surface 222 such that end 280 extends beyond the perimeter of cross-member 76 when body-support portion 80 is mounted on cross-member 76. The shape of end 278 and the oblique orientation of upper surface 272 to upper surface 86 of cross-member 76 is shaped to conform to the contour of a patient's body such that the body-support portion 80 may engage the shoulder or hip area when the patient is supported in the supine or prone position.

Figure 8:
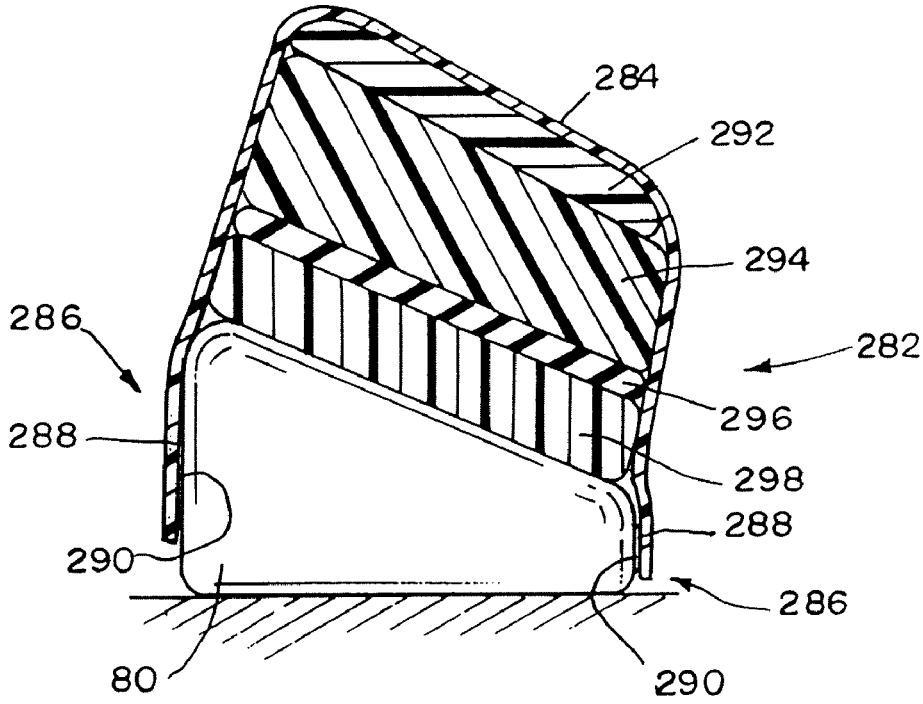
FIG. 8 is a cross-sectional view of a portion of the body-support apparatus of FIG. 5 with a multi-layer foam cushion mounted on a body-support portion of the body-support apparatus.
Figure 9:
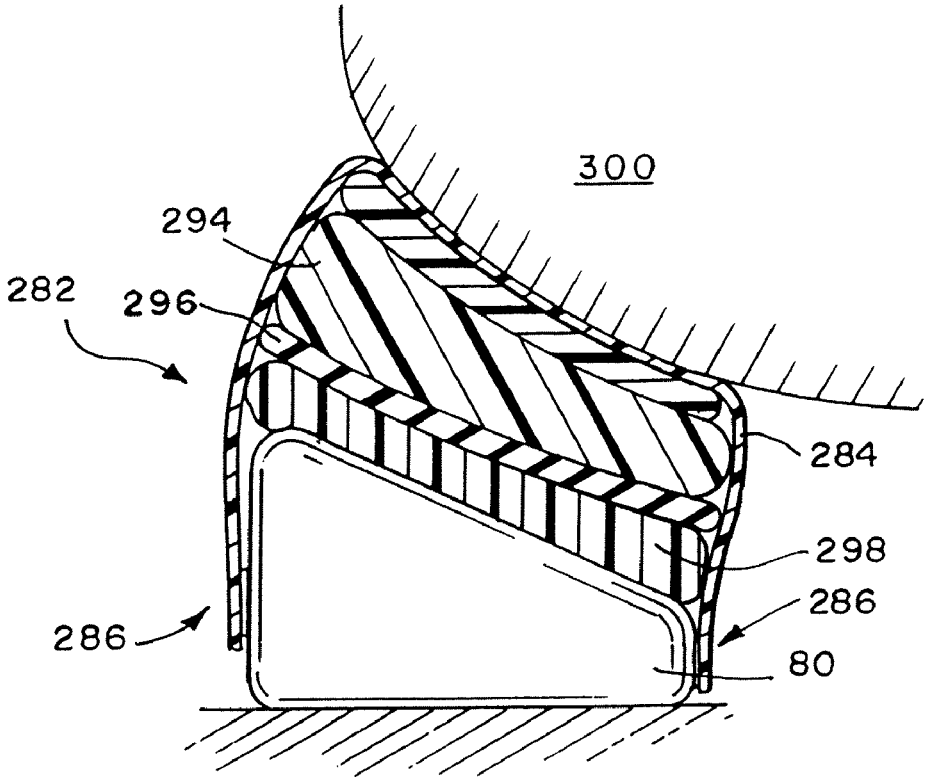
FIG. 9 is a cross-sectional view of the body-support portion and cushion of FIG. 8 with a patient positioned on the cushion such that the cushion is compressed under the load of the patient.

In some embodiments, a body-support portion such as body-support portion 80 may provide a base of support and be covered by a cushion assembly 282 as shown in FIGS. 8 and 9. Cushion assembly 282 comprises a cover 284 which is coupled to body-support portion 80 by a system of hook-and-loop-fasteners 286. A first portion 288 of hook-and-loop-fastener 286 is coupled to cover 284. A second portion 290 of the hook-and-loop-fastener 286 is coupled to perimeter surface 222 of body-support portion 80 and positioned so that it may be engaged by first portion 288 to secure cover 284 to body-support portion 80. Cushion assembly 282 further comprises four layers of material which is shaped and positioned to provide support when a portion of a patient 300 is supported above cushion assembly 282 and body-support portion 80. In the illustrative embodiment of FIGS. 8 and 9, an upper layer 292 has a generally uniform thickness of about 1 inch. Layer 292 comprises polyether polyurethane foam configured to conform to the contour of a patient 292 supported on cushion assembly 282. Depending on the application, layer 292 may have various thicknesses from about ½ inch to about 1½ inches.

Layer 292 is supported on a foam distribution layer 294 which has a thickness of about 2 inches and comprises polyester based flexible polyurethane foam. Layer 294 is configured to distribute the weight of a patient 300 supported on cushion assembly 282. Cushion assembly 282 further comprises a diaphragm layer 296 which comprises polyvinyl chloride-nitrile rubber. Diaphragm layer 296 has a generally uniform thickness of about ¼ inch and acts as a semi-rigid support to distribute forces transferred through layer 294. In some embodiments, diaphragm layer 296 may have a thickness of between about ¼ inch and about ½ inch. In still other embodiments, diaphragm layer 296 may be omitted.

Diaphragm layer 296 is supported on base layer 298 comprising polyethylene foam having a generally uniform thickness of about 1½ inches. Base layer 298 is configured to provide a resilient support surface for layers 292, 294, and 296 and serves to prevent a patient 300 from bottoming out against main portion 164 of body-support portion 80. In some embodiments, base layer 298 may have a thickness of between about 1 inch and 2 inches.

When assembled, cushion assembly 282 distributes the load of patient 300 as shown in FIG. 9 such that the load is distributed across a portion of the patient's body to reduce the potential for injury and discomfort. The shape of cushion assembly 282 and body-support portion 80 is suited to support a patient 300 in a supine or prone position by engaging the iliac crest of the patient near the patient's hip and by supporting the patient's chest without applying pressure to the brachial plexus. Avoiding the brachial plexus reduces the potential of injuring nerves or blood vessels in that area. Additionally, the sloping shape of support 80 and thereby cushion assembly 282 provides lateral support to the patient so that the patient 300 is maintained in a position generally above accessory frame 12.

It should be understood that the illustrative embodiment of cushion assembly 282 may be configured to be secured to any of number of body-support portions and the coupling of cushion assembly 282 to body-support portion 80 is exemplary in nature.

Figure 14:
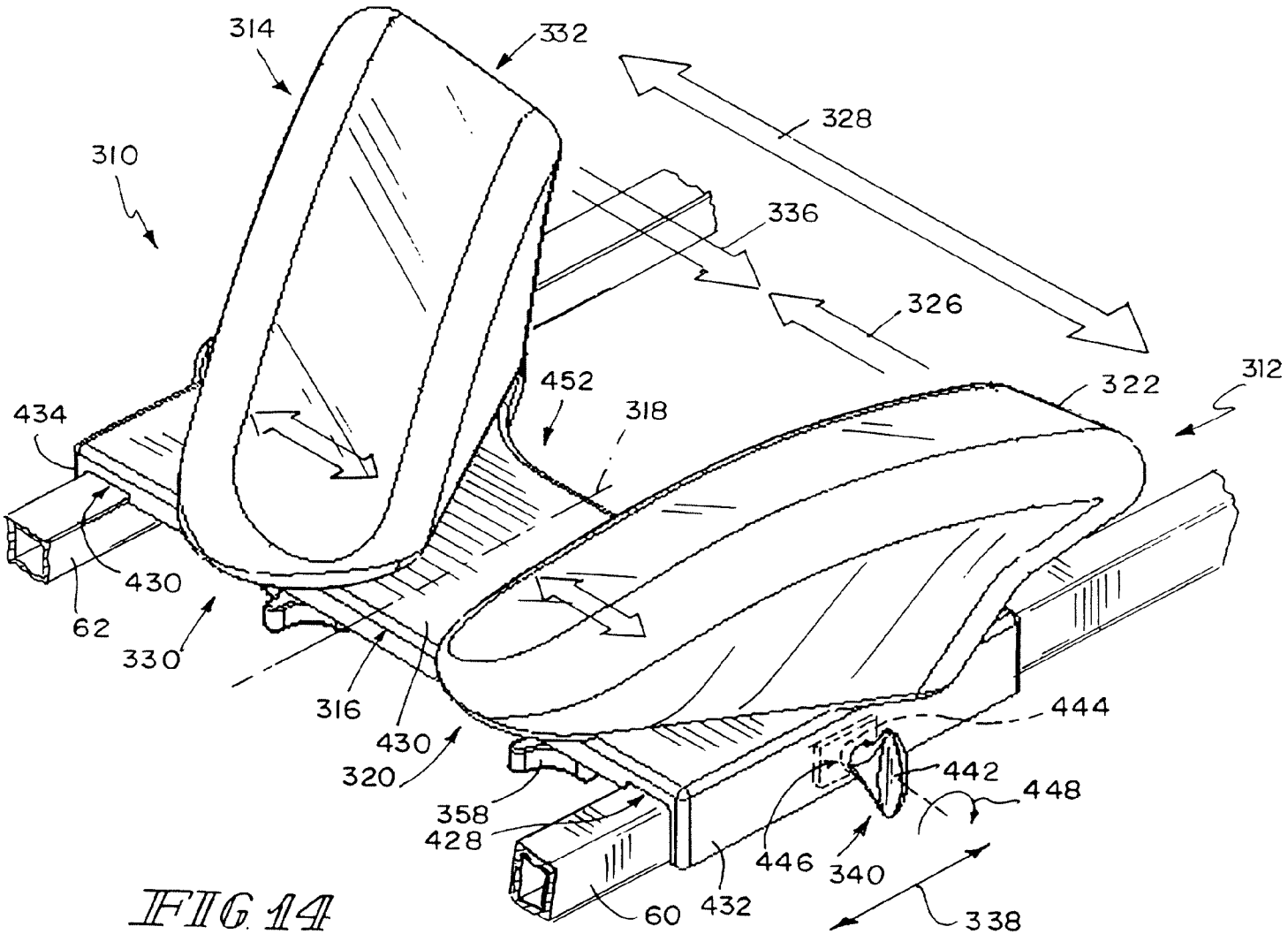
FIG. 14 is a perspective view of another embodiment of a body-support apparatus including adjustable opposing body-support portions configured to pivot and translate relative to a cross-member to conform to the shape of a patient's body.

For example, a body-support apparatus 310 includes opposed body-support portions 312 and 314 which are adjustable laterally relative to a frame 316 as shown in FIG. 14. Each body-support portion 312, 314 is adjustable laterally to change the relative distance therebetween as depicted by arrow 328. Accessory frame 12 has a longitudinal axis 318 which bisects first member 60 and second member 62. Body-support portion 312 has a forward end 320 and a rear end 322. Adjustment of the lateral position of body-support portion 312 is accomplished by adjusting the lateral position of front end 320 as depicted by arrow 324 and by independently adjusting the lateral position of rear end portion 322 as depicted by arrow 326.

Support portion 314 is symmetrical to body-support portion 312 and has a front end 330 and a rear end 332. Front end 330 is adjustable as depicted by arrow 334 and rear end 332 is adjustable as depicted by arrow 336. Frame 316 is positionable along the length of members 60 and 62 as depicted by arrow 338 and may be secured in place by a locking knob 340.

Figure 15:
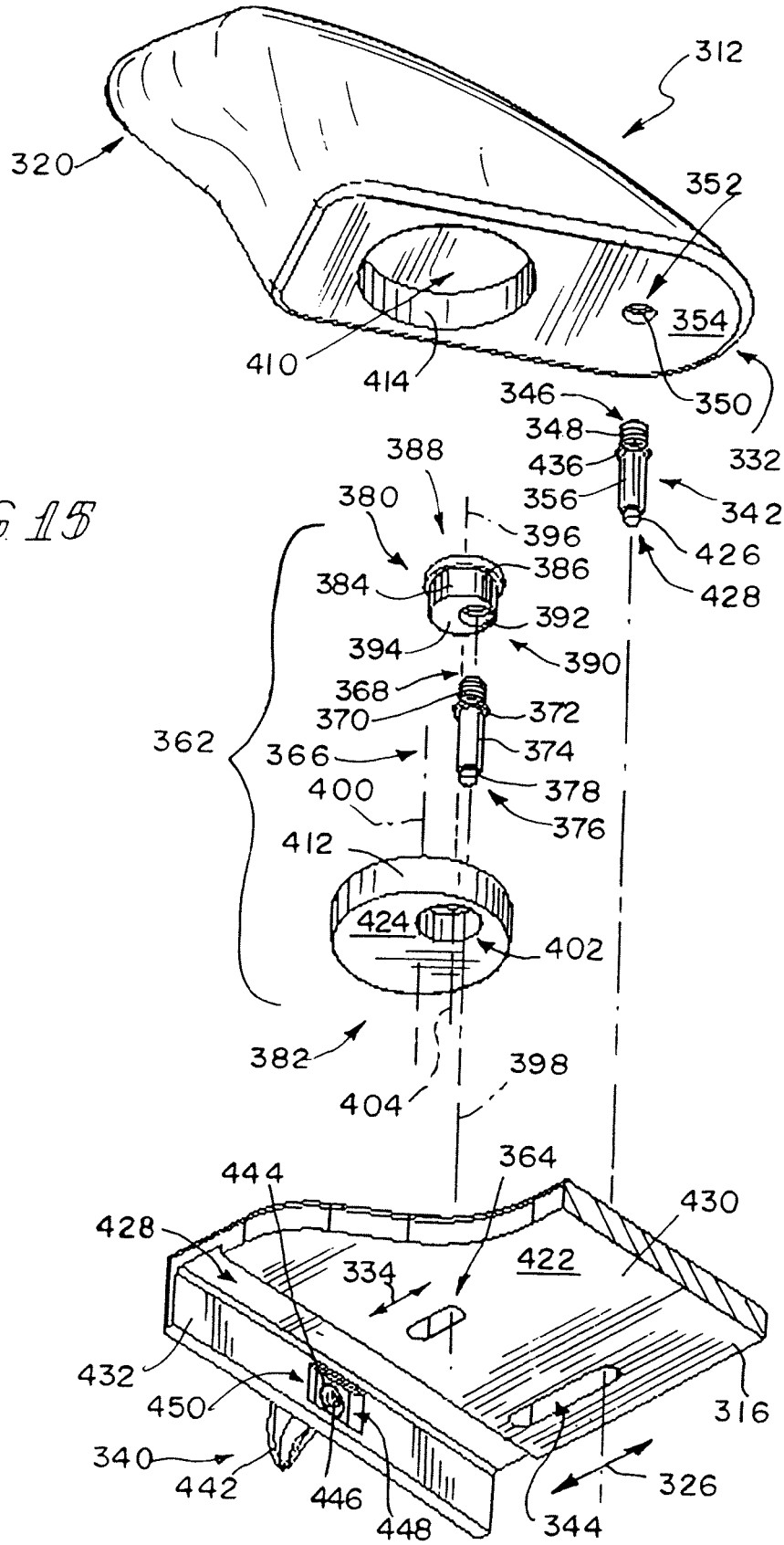
FIG. 15 is an exploded view of a portion of the body-support apparatus of FIG. 14 including a pivot pin and an eccentric pivot assembly.
Figure 16:
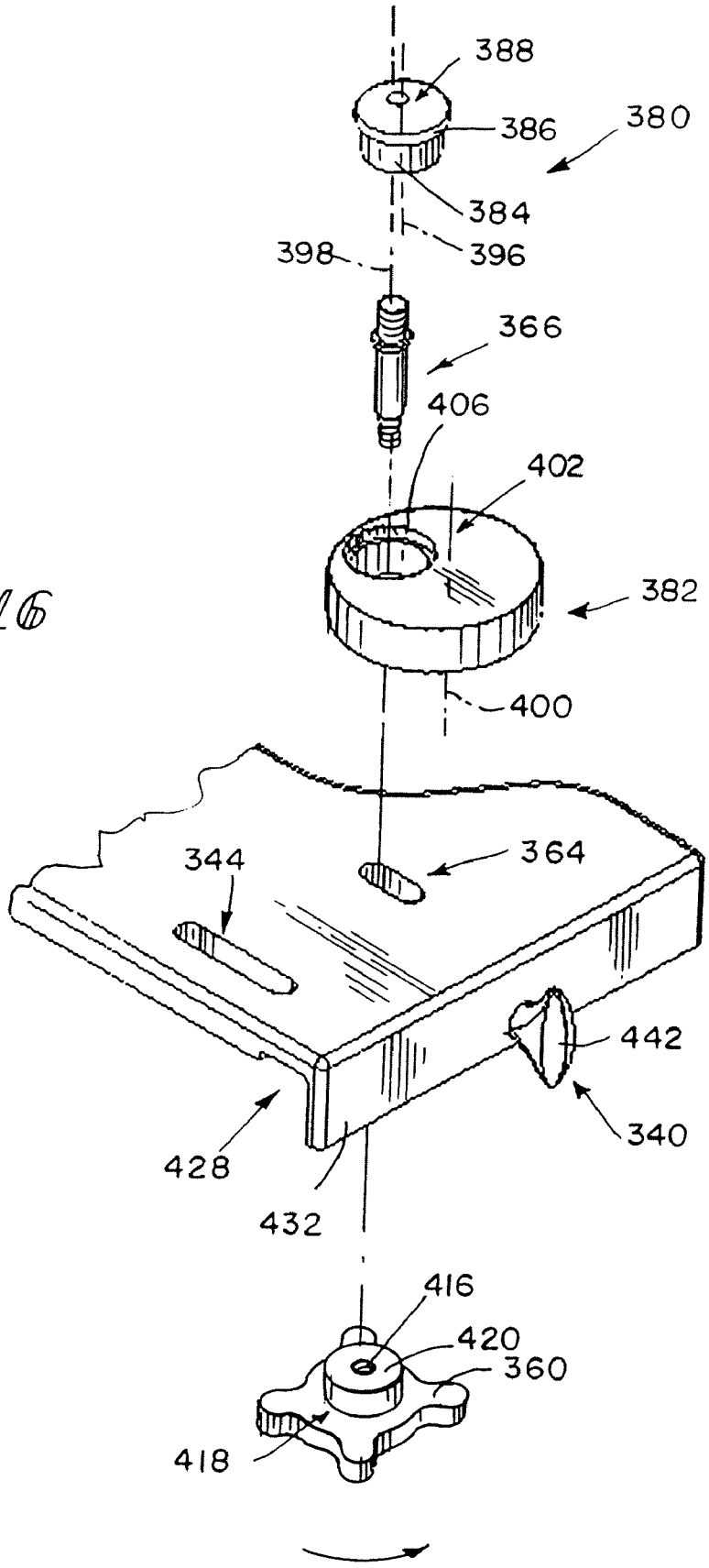
FIG. 16 is an exploded view of the eccentric pivot assembly of FIG. 15.

The adjustment of body-support portions 312 and 314 is best understood with reference to FIGS. 15 and 16. FIG. 15 shows body-support portion 312 and a portion of frame 316. Body-support portion 312 comprises polyethylene rotomolded to shape. Body-support portion 312 is coupled to frame 316 through a fastener 342 proximate rear end 322 and a cam mechanism 362 proximate front end 320. Fastener 342 comprises an ultra-high-molecular-weight (UHMW) polyethylene and is configured to be secured to body-support portion 312 and move in a slot 344 formed in frame 316. Fastener 342 has a first end 346 comprising male threads 348 which are configured to be received by female threads 350 formed in the wall of a hole 352 formed in a lower surface 354 of body-support portion 312.

First end 346 is threaded into hole 352 until a flange 436 of fastener 342 engages lower surface 354 of body-support portion 312. Slot 344 is sized to receive a shaft 356 of fastener 342 such that fastener 342 is free to move within slot 344 in the longitudinal direction of arrow 326. A knob 358 is used to secure rear end 322 in position in any of a plurality of positions along slot 344. The operation of knob 358 is identical to the operation of knob 360 as will be described below.

Knob 360 is used to secure front end 320 which moves along slot 364. The motion of front end 320 is more complex than that of rear end 322 in that cam assembly 362 results in an eccentric motion. Cam assembly 362 comprises a fastener 366 which is identical to fastener 342 but is given a separate designator for clarity. Fastener 366 includes a first end 368 with male threads 370, a flange 372, a shaft 374 and a second end 376 with male threads 378. Cam assembly 362 further comprises a first follower 380 and a second follower 382. First follower 380 has a main portion 384 which has a generally cylindrical shape and a flange 386 formed at a top end 388. First follower further includes a hole 390 formed in a lower surface 394, the whole 390 having a generally cylindrical shape with female threads 392 formed therein. Male threads 370 of fastener 366 are configured to engage female threads 392 to couple fastener 366 to first follower 380. First end 368 is received within the whole 390 until flange 372 engages surface 394 of first follower 380.

First follower 380 has a longitudinal axis 396. Hole 390 has a longitudinal axis 398 which is offset from axis 396. The offset of axes 396 and 398 provides the basis for a first eccentric motion of cam assembly 362.

Second follower 382 has a generally cylindrical shape defining a longitudinal axis 400. Second follower 382 and includes a through-hole 402 which has a generally cylindrical shape and is sized to receive main portion 384 of first follower 380. Through-hole 402 defines yet another longitudinal axis 404 which is offset from longitudinal axis 400. The offset between longitudinal axes 404 and 400 provides a basis for a second eccentric motion of cam assembly 362. Referring to FIG. 16, second follower 382 has a relief area 406 formed at the top of through-hole 402 and configured to receive flange 386 of first follower 380.

When assembled, cam assembly 362 engages an upper surface 408 of frame 316 and the shaft 374 of fastener 366 is received within slot 364 such that fastener 366 is free to move within slot 364 as depicted by arrow 334. Cam assembly 362 is received within a cavity 410 formed in lower surface 354 of body-support portion 312. Second follower 382 has a perimeter surface 412 which is sized to be received within cavity 410 such that the diameter of an annular surface 414 of cavity 410 provides sufficient clearance for second follower 382 to rotate within cavity 410. Rotation of second follower 382 results from the compound motion of first follower 380 and second follower 382.

Once body-support portion 312 is positioned as desired, they can be secured in place by tightening knobs 358 and 360. As shown in FIG. 16, male threads 378 formed on second end 376 of fastener 366 engage female threads 416 formed in knob 360. Knob 360 includes an annular protrusion 418 with an upper surface 420. Upper surface 420 engages a lower surface 422 of frame 316 when knob 360 is rotated about axis 398 which is coincident with the longitudinal axis of fastener 366. The tightening of knob 360 causes tension to be developed in fastener 366 which pulls first follower 380 downwardly such that flange 386 engages relief area 406 of second follower 382 thereby compressing second follower 382 and causing a friction lock between a lower surface 424 of second follower 382 and upper surface 408 of frame 316. This locks cam assembly 362 relative to frame 316 to prevent movement of front end 320 of body-support portion 312.

Similarly, knob 358 (best seen in FIG. 14) engages male threads 426 formed in a second end 428 of fastener 342. As knob 358 is tightened, tension is developed in fastener 342 which draws body-support portion 312 down such that lower surface 354 of body-support portion 312 is frictionally locked to upper surface 408 of frame 316. Thus when knobs 358 and 360 are tightened, body-support portion 312 is secured relative to frame 316.

Frame 316 is configured to be supported on accessory frame 12. Frame 316 includes a cross-member 430 and opposing flanges 432 and 434. Two channels 438 and 440 are formed in lower surface 422 adjacent flanges 432 and 434 respectively. Channels 438 and 440 traverse cross-member 430 and are sized to receive members 60 and 62 to prevent lateral movement of body-support apparatus 312 relative to accessory frame 14. Locking knob 340 is positioned on the outward side of flange 432. Locking knob comprises a handle 442 coupled to a threaded shaft 444 having male threads. Threaded shaft 444 is received within a through-hole 446 having female threads formed in flange 432 and has sufficient length to extend through flange 432 such that the end of threaded shaft 444 engages member 60. As locking knob 340 is rotated about the axis of the threaded shaft 444 in the direction of arrow 448, threaded shaft 444 develops sufficient force normal to member 60 to frictionally secure frame 316 to member 60. Another locking knob 340 is positioned on flange 434 and frictionally secures frame 316 to member 62 in the same way. In some embodiments, locking knob 340 may further include a treatment such as a rubber tip, for example, on the end of threaded shaft 444 which increases the frictional coefficient between locking mechanism 340 and members 60, 62 to increase the all holding force of locking knob 340 when frame 316 is secured two members 60, 62.

Each flange 432, 434 includes a cavity 450 formed on and inward surface nearer through hole 448 to provide clearance for threaded shaft 444 to be retracted so as to provide clearance for flanges 432 and 434 in two fully engage a members 60 and 62 respectively when frame 316 is positioned on members 60 and 62. In some embodiments, locking knob 340 may include a pad secure to the end of threaded shaft 444. The pad may serve to distribute the force generated in shaft 444 over a greater area of member 60 or 62 to improve the effectiveness of locking knob 340. The pad may comprise rubber or some other elastomeric material.

Frame 316 is formed such that a clearance area 452 is defined in the area between a rear end 322 of body-support portion 312 and rear end 332 of body-support portion 314. Clearance area 452 provides room for a portion of the abdomen of a patient supported on body-support apparatus 310 in a supine or prone position.

In another embodiment of a body-support apparatus 454, a cushion 456 is a unitary member configured to support both sides of a patient's body and is supported on two body-support portions 468 and 470 as shown in FIG. 20-28. Body-support portions 468 and 470 are supported on a frame 458 configured to be supported on a surgical table 66 or an accessory frame 12. Each body-support portion 468, 470 is coupled to frame 458 at two points by a system of hook-and-loop-fasteners 482, 484, 486 and 488. Body-support portions 468 and 470 are adjustable relative to frame 458 by adjusting one or more of the systems of hook-and-loop-fasteners 482, 484, 486 and 488.

Cushion 456 is a pliable structure which flexes to conform to the contours of a patient support thereon when body-support portions 468 and 470 are adjusted relative to frame 458. Cushion 456 includes outward portions 462 and 464 which are interconnected by a central portion 466. Central portion 466 bridges outward portions 462 and 464.

Each system of hook-and-loop-fasteners 482, 484, 486 and 488 includes a strap 490, a first length of hook portion 492 coupled to strap 490 near one end and a second length of hook material 494 coupled to strap 490 near end opposite the first length 492. Each system 482, 484, 486 and 488 further includes a length of loop material 496 coupled frame 458 and a length of loop material 498 coupled to a lower surface of one of the body-support portions 468 or 470.

Figure 20:
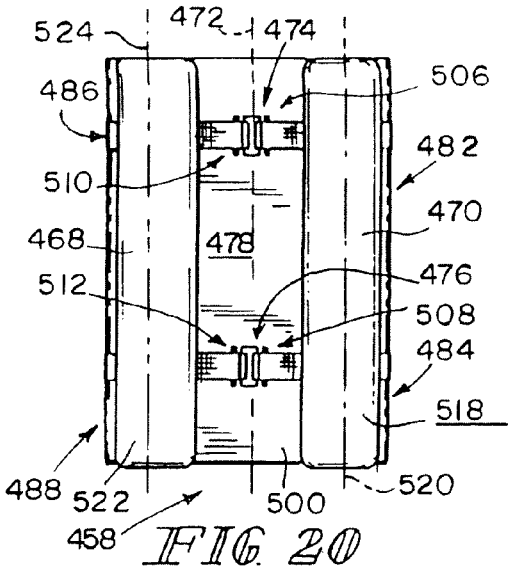
FIG. 20 is a top view of another embodiment of a body-support apparatus including two body-support portions adjustable relative to a support plate to be positioned to conform to the contour of a patient in a supine or prone orientation, the body-support portions secured in position by a system of hook-and-loop-fasteners.
Figure 21:
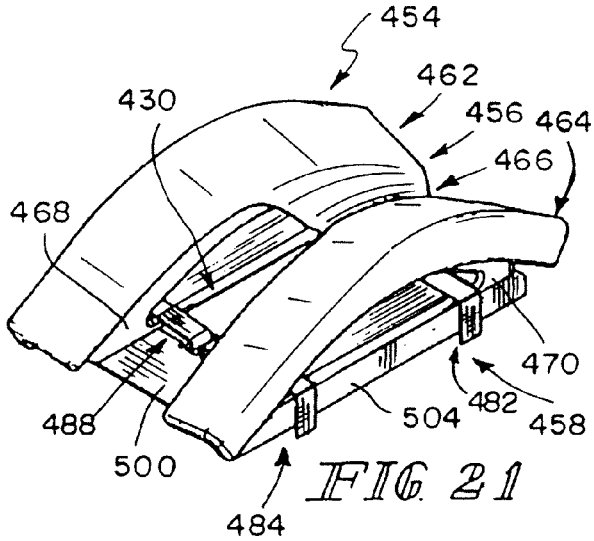
FIG. 21 is a perspective view of yet another embodiment of a body-support apparatus similar to the body-support apparatus of FIG. 20, the body-support apparatus of FIG. 21 having a unitary flexible body-support portion which is supported on a support plate and adjustable to conform to the contour of a patient in a supine or prone orientation, the body-support portion secured and adjusted by a system of hook-and-loop-fasteners.
Figure 22:
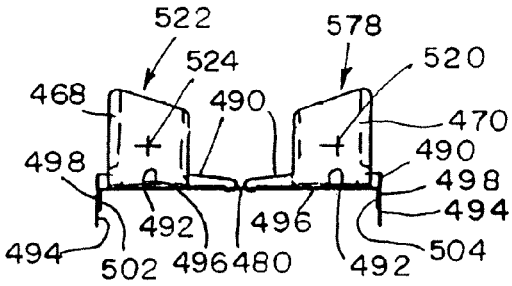
FIG. 22 is an end view of the body-support apparatus of FIG. 20 with the body-support portions positioned in a parallel orientation.

Referring now to FIG. 20, frame 458 has a central longitudinal axis 472. Frame 458 includes a main portion 500, and two flanges 502, 504 positioned along the longitudinal sides of main portion 500 and extending vertically downward therefrom (best seen in FIG. 22). Two apertures 474 and 476 communicate from an upper surface 478 of main portion 500 to a lower surface 480. Four additional apertures 506, 508, 510 and 512 are formed in main portion 500 and communicate from upper surface 478 to lower surface 480.

Figure 23:
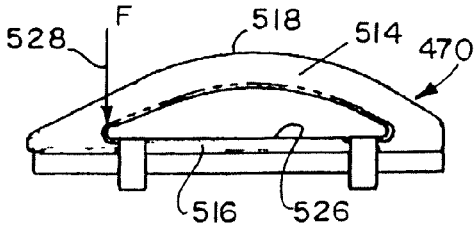
FIG. 23 is a side view of the body-support apparatus of FIG. 20 with the body-support portions positioned in a parallel orientation.
Figure 24:
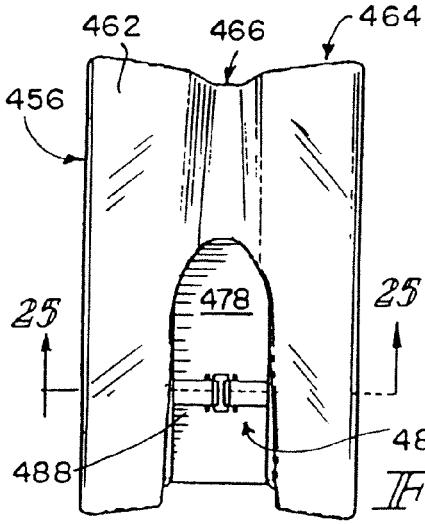
FIG. 24 is a top view of the body-support apparatus of FIG. 21 with the body-support portions positioned in a parallel orientation.

Referring to FIG. 23, body-support portion 470 includes an arched portion 514 and a lower portion 516. Arched portion 514 spans the longitudinal length of body-support portion 470 and is coupled to lower portion 516 at opposite ends. Body-support portion 470 has a longitudinal axis 520 which extends along the longitudinal length of body-support portion 470 Body-support portion 470 has an upper surface 518 which extends over the length of arched portion 514 and has an arched profile when viewed perpendicular to axis 520. Surface 518 has an inclined profile when viewed along axis 520 and is spaced at a greater vertical distance from upper surface 478 at an outward side of body-support portion 470 such that surface 518 declines from outward to inward. Body-support portion 468 is symmetrical to body-support portion 470 and has an upper surface 522 which mirrors surface 518. In addition, body-support portion 468 has a longitudinal axis 524. The shape of surfaces 518 and 522 provide support to the chest area of a patient supported in a supine or prone position on body-support apparatus 454.

Figure 27:
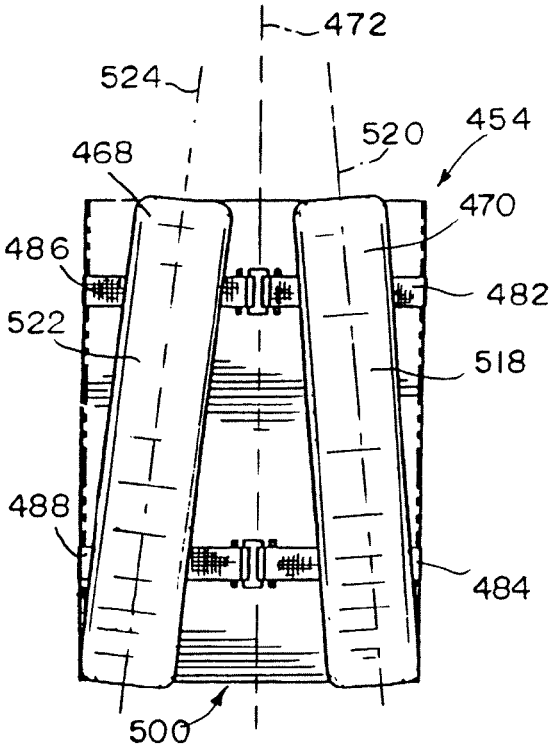
FIG. 27 is a top view of the body-support apparatus of FIG. 20 adjusted such that opposing sides of the body-support portion are deflected toward the centerline of the apparatus.
Figure 28:
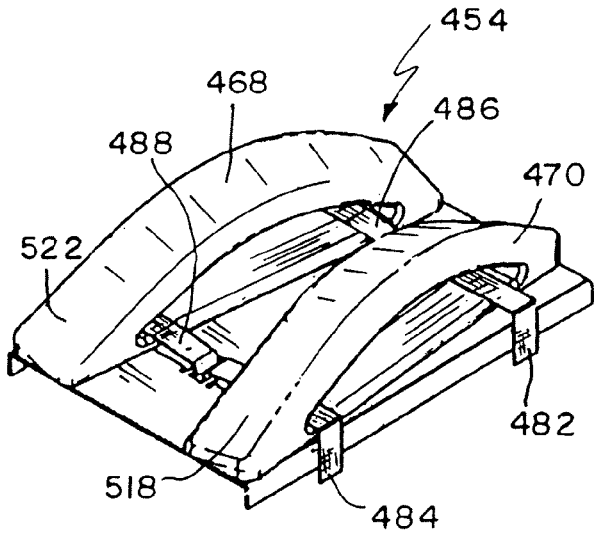
FIG. 28 is a perspective view of the body-support apparatus of FIG. 20 adjusted such that opposing sides of the body-support portion are deflected toward the centerline of the apparatus.
Figure 29:
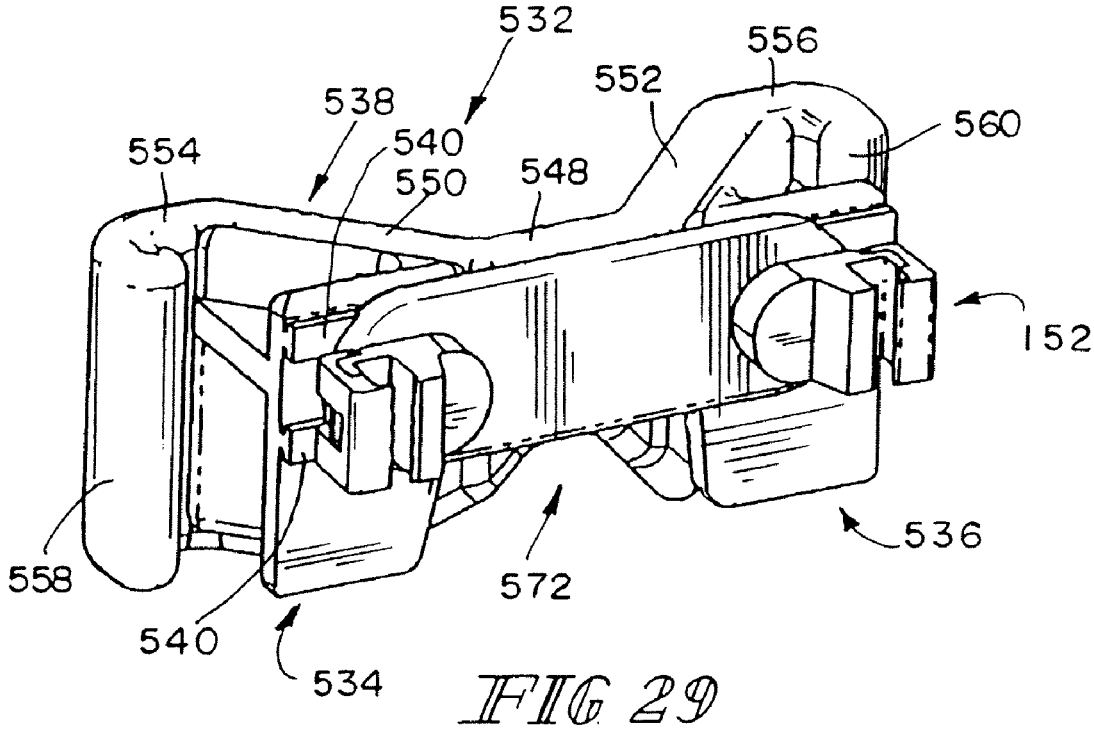
FIG. 29 is a perspective view of still yet another embodiment of a body-support apparatus, the apparatus having a unitary body-support portion with spaced apart protrusions.
Figure 30:
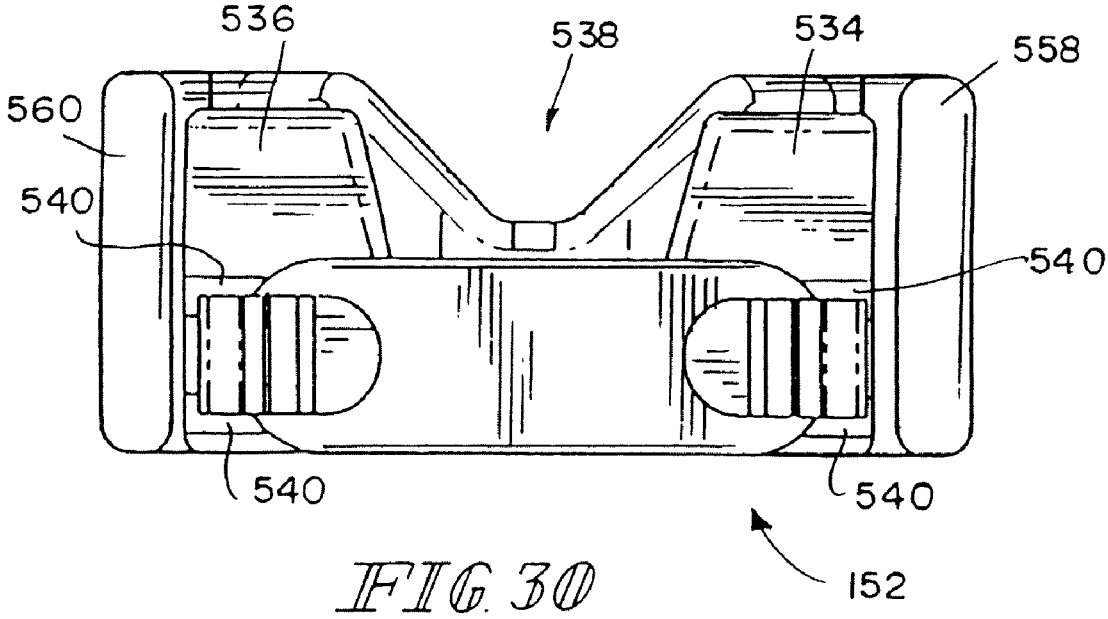
FIG. 30 is a bottom plan view of the apparatus of FIG. 29.

The relative relation of body-support portions 468 and 470 can be adjusted by adjusting the systems of hook-and-loop-fasteners 482, 484, 486 and 488. For example, body-support portions 468 and 470 can be adjusted such that axes 520 and 524 are substantially parallel to one another and to axis 472 as is illustrated in FIG. 20. However, adjustment of the systems of hook-and-loop-fasteners 482, 484, 486 and 488 permit body-support portions 468 and 470 to be adjusted to be in a non-parallel orientation as shown in FIGS. 27 and 28. Adjustment of body-support portions 468 and 470 allows for body-support apparatus 454 to be adjusted to conform to the contour of the body of a patient supported thereon.

Referring to FIGS. 20 and 22-25, the system of hook-and-loop-fasteners 484 is illustrative of the operation of all of the systems of hook-and-loop-fasteners 482, 484, 486 and 488 in adjusting the orientation of body-support portions 468 and 470 relative to frame 458. Hook portion 492 is engaged with loop portion 496 so that strap 490 is coupled to body-support portion 470. Strap 490 extends inward, passes over surface 478 and is fed into aperture 508. A portion of strap 490 is engaged with lower surface 480 and strap 490 passes up through aperture 476 and back outwardly over the portion of strap 490 passing over surface 478. Strap 490 further extends outwardly over a surface 526 of lower portion 516 of body-support portion 470 and then vertically downwardly along flange 504 so that hook portion 494 engages loop portion 498 which is coupled to flange 504 of frame 458. When strap 490 is secured in place, body-support portion 470 is secured from moving outwardly when a patient is supported thereon. Due to the incline of surface 518 when viewed along axis 520, the load of a patient supported body-support portion 470 urges body-support portion 470 outwardly. The system of hook-and-loop-fasteners 484 counteracts this urge by developing tension in strap 490 and developing a normal force depicted by arrow 528 which urges body-support portion 470 against surface 478, thereby increasing the frictional resistance against lateral movement of body-support portion 470

Each of the systems of hook-and-loop-fasteners 482, 484, 486 and 488 operate in a substantially similar way. When hook portion 494 is released from loop portion 498, body-support portion 470 is free to move laterally relative to frame 458. Thus, body-support portion 470 can be moved inwardly and hook portion 494 can be re-engaged with loop portion 498 to secure body-support portion 470 in a new lateral position. Referring to FIGS. 27 and 28, systems of hook-and-loop-fasteners 484 and 486 have been adjusted so that one end of each of body-support portions 468 and 470 have been adjusted inwardly to form v-shaped configuration. It should be understood that systems of hook-and-loop-fasteners 482, 484, 486 and 488 can be adjusted to change the angle between axes 520 and 524 as well as the relative lateral distance between body-support portions 468 and 470.

Figure 25:
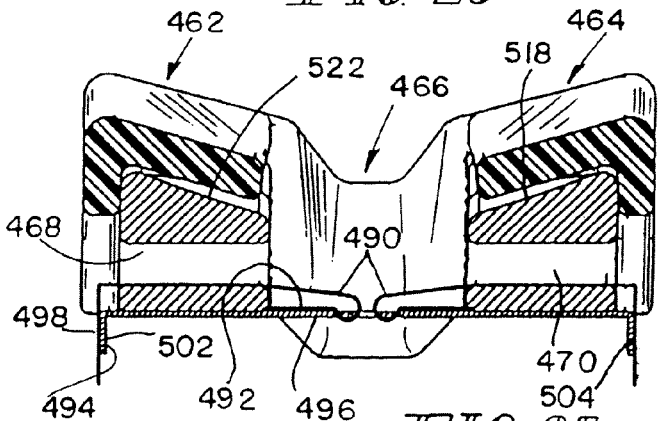
FIG. 25 is a cross-sectional view of the body-support apparatus of FIG. 28 viewed along a central axis as depicted by the section line 25-25 of FIG. 28.

Referring to FIG. 25, cushion 456 is positioned to be supported by body-support portions 468 and 470 and to provide a resilient support surface between body-support portions 468 and 470. Body-support portions 468 and 470 comprise polyethylene roto-molded to shape. Cushion 456 comprises a polyether polyurethane foam configured to conform to the contour of a patient supported on body-support apparatus 454 and has a thicknesses from about ½ inch to about 1½ inches. Cushion 456 is formed to define a clearance area 430 which permits the abdomen of a patient to drape between outboard portions 462 and 464. Central portion 466 supports the upper chest area of a patient.

Figure 26:
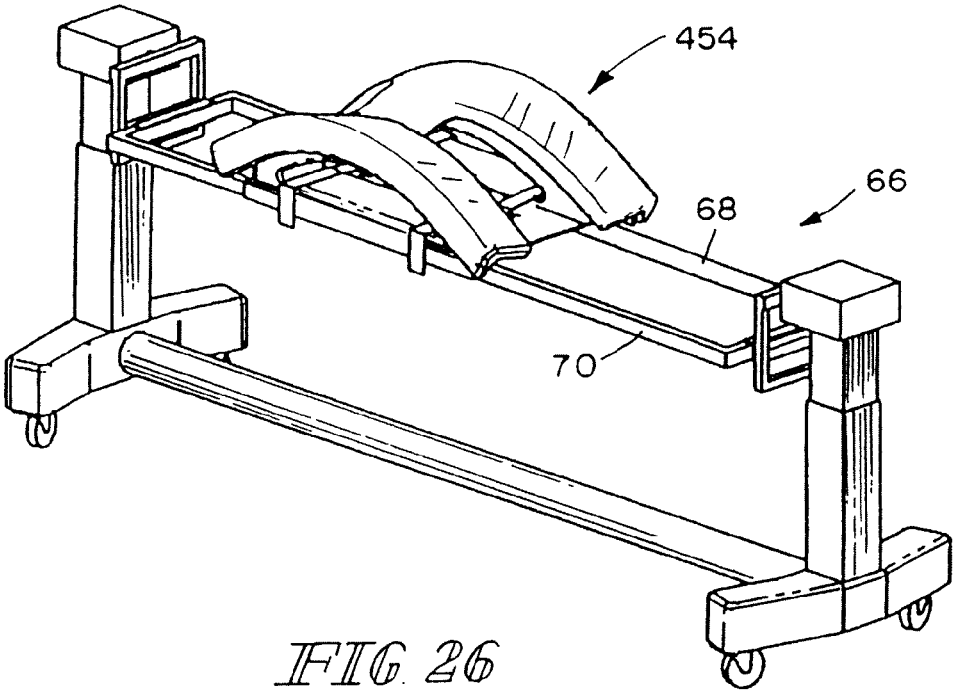
FIG. 26 is a perspective view of a surgical table having two parallel members extending between two extensible posts, the surgical table including the body-support apparatus of FIG. 21 engaged with the parallel members.

As shown in FIG. 26, frame 458 is configured to be received on members 68 and 70 of surgical table 66. While the illustrative embodiment of FIGS. 20-28 does not include a locking mechanism, it should be understood that locking knob 340 of the illustrative embodiment of FIGS. 14-16 could be coupled to frame 458 to secure body-support apparatus 454 members 68 and 70. In other embodiments, body-support apparatus 454 may further comprise a support assembly such as support assembly 152 of the illustrative embodiment of FIGS. 5-13*b*.

Yet another embodiment of a body-support apparatus 532, shown in FIGS. 29-33, comprises a support assembly 152, two Supports 534 and 536 engaged with support assembly 152 and adjustable laterally relative thereto, and a cushion 538 supported on the Supports 534 and 536. Support assembly 152 comprises cross-member 76 and couplers 72 and 74 as discussed above.

Each support 534, 536 of body-support apparatus 532 is configured to engage with channels 154 and 156 of cross-member 76 and to move along longitudinal axis 82 to change the relative distance therebetween. Each support 534, 536 comprises a radiolucent material. In the exemplary embodiment, Supports 534 and 536 comprise ABS which is radiolucent. Cushion 538 comprises polyether polyurethane foam configured to conform to the contour of a patient supported on body-support apparatus 532 and has a thickness of about 1 inch. In other embodiments, cushion 538 may have a thickness of between about ½ inch to about 1½ inches.

Figure 33:
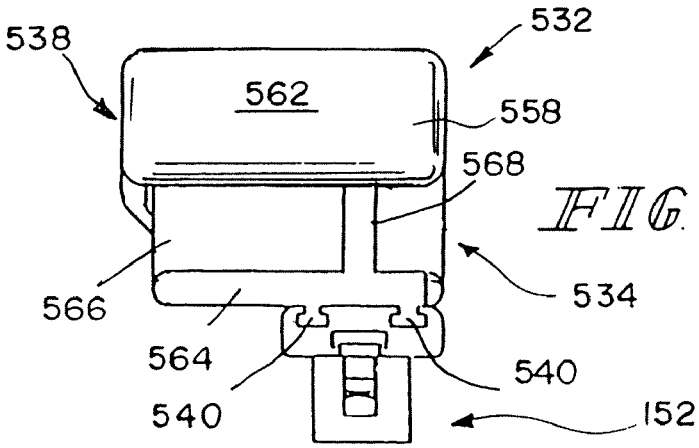
FIG. 33 is a side view of the body-support apparatus of FIG. 29.

Referring to FIG. 33, support 534 includes two t-shaped ribs 540 which are configured to be received in t-shaped channels 154 and 156 in cross-member 76. Ribs 540 are sized to permit free movement within channels 154 and 156. Support 536 is symmetrical to support 534 and also includes ribs 540. Supports 534 and 536 are free to move relative to one another along axis 82 to change the spacing therebetween. When support 534 is moved along axis 82 as depicted by arrow 544 and support 536 is moved along axis 82 as depicted by arrow 546, the spacing of a gap 542 is varied. This variation allows body-support apparatus 532 to be adjusted to fit a particular patient.

Figure 31:
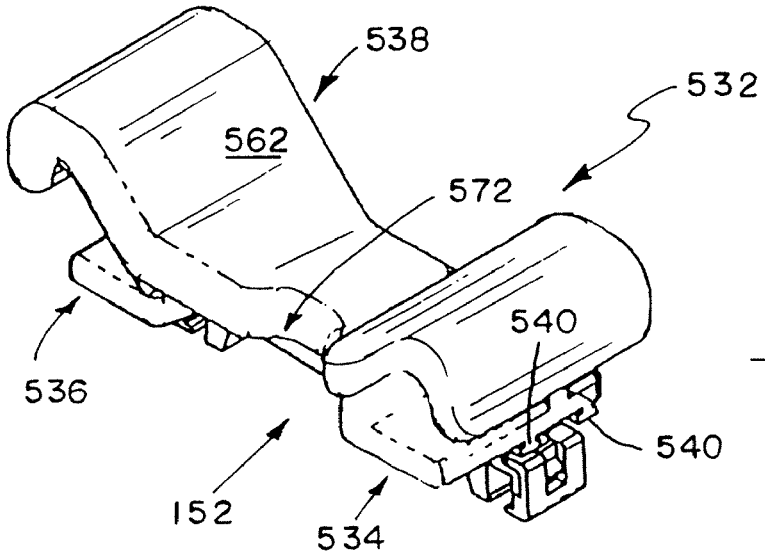
FIG. 31 is a perspective view of the bottom of the body-support apparatus of FIG. 29.
Figure 32:
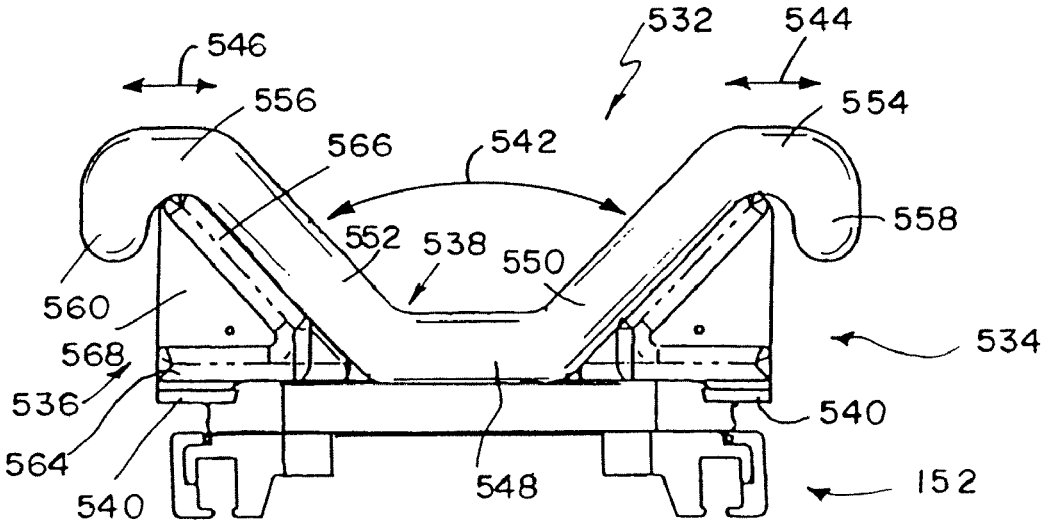
FIG. 32 is a plan view of the body-support apparatus of FIG. 29.

As shown in FIG. 32, cushion 538 has a lower portion 548, two angled portions 550 and 552, two upper portions 554 and 556, and two bumper portions 558 and 560. An upper surface 562 of cushion 538 is configured to engage a chest area or pelvic area of a patient supported on body-support apparatus 532 in a supine or prone position. The shape of cushion 538 including bumper portions 558 and 560 reduce the potential for a patient to contact a rigid portion of body-support apparatus 532. Referring to FIG. 31, cushion 538 is shaped to form a clearance area 572 in lower portion 548.

Supports 534 and 536 include are shaped to provide a high strength-to-weight ration in the direction force will be exerted. Illustratively, support 534 includes a base portion 564 coupled to a body-support portion 566, and web portion 568. Base portion 564 is a generally planar member and includes ribs 540 formed in a lower surface 570. Body-support portion 566 is a generally planar member extending at an acute angle from one end of base portion 564. Body-support portion 564 is configured to support angled portion 550 of cushion 538. Web portion 568 is a generally planar member which is perpendicular to the central planes of portions 564 and 566. Web portion 568 transfers the load on body-support portion 566 to base portion 564 directly above cross-member 76 so that the load may be transferred to support assembly 152 without deflecting support 534. Support 536 is configured in the same way including a base portion 564, body-support portion 566, and a web portion 568.

Cushion 538 is coupled to cross-member 76 and to supports 534 and 536. In the illustrative embodiment of FIGS. 29-33, supports 534 and 536 are secured relative to cross-member 76 by interference between ribs 540 and slots 154 and 156. In some embodiments, Supports 534 and 536 may each further include a locking mechanism 274 as shown in the illustrative embodiment of FIG. 5-12. In still other embodiments, supports 534 and 536 may be coupled together to form a unitary structure such that gap 542 is of a fixed size. It should be understood that variations of support assembly 152 have been disclosed in which couplers 72 and 74 pivot relative to cross-member 76 and in which one or both of couplers 72 and 74 translate relative to cross-member 76 along axis 82.

Another embodiment of body-support apparatus 574 shown in FIGS. 40-46 includes a cross-member 576, two couplers 578 and 580 pivotably coupled to cross-member 576, and two supports 582 and 584 engaged with cross-member 576 and slidable along a longitudinal axis 586 of cross-member 576. Supports 582 and 584 are independently engaged with cross-member 576 so that they may be adjusted to vary the distance therebetween. Also, supports 582 and 584 are adjustable to vary the distance from each support relative to a central axis 586 of body-support apparatus 574. For example, in FIG. 45 support 584 is positioned closer to central axis 586 than is support 582. When supports 582 and 584 are adjusted at different distances from central axis 586, a gap represented by arrow 588 is bisected by axis 590 which is offset from central axis 586. This permits a portion of a patient supported on body-support apparatus 574 to be positioned offset from the longitudinal axis of a patient-support apparatus as will be discussed in more detail below.

Body-support apparatus 574 further comprises a cushion 592 coupled to and supported on cross-member 576. Each support 582 and 584 supports a cushion 594. Cushion 592 has an upper surface 596. Each cushion 594 has an upper surface 598. Surfaces 598 are positioned at an obtuse angle to surface 596 and surfaces 596 and 598 define the boundaries of gap 588. Each of the cushions 592, 594 and 594 are configured to engage a portion of a patient supported on body-support apparatus 574. Cushions 594 are coupled to supports 582 and 584. Supports 582 and 584 are identical components, but are identified by separate designators to simply a discussion of relationships therebetween.

Cross-member 576 is an elongate member having a front side 600 and a rear side 602. Cross-member 576 is also defined by a left side 604 and a right side 606. In the illustrative embodiment of FIGS. 40-46, the orientation of cross-member 576 relates various aspects of the cross-member 576 and the body-support apparatus 574 to two mounts 608 and 610 which are positioned at the front side 600. Mounts 608 and 610 extend vertically downward from a bottom surface 612 of cross-member 576. Mounts 608 and 610 are each configured to receive a connector 614 of a head support apparatus 616 (seen in FIGS. 2-4). A cylindrical through-hole 618 is near left side 604 of cross-member 576 and has a circular cross-section which defines an axis 620. Through-hole 618 is configured to receive a stem (not shown) of coupler 580 such that coupler 580 is pivotable about axis 620 relative to cross-member 576. Coupler 580 includes a channel 622 which is sized to engage a member of a patient-support apparatus such as members 68 or 70 of surgical table 66. Cross-member 576 includes a relief area 624 formed in lower surface 612 which provides clearance for coupler 580 to pivot.

Another through-hole 626 has an oval-shaped cross-section when viewed parallel to axis 620. Through-hole 626 is configured to receive a stem (not shown) of coupler 578. When coupler 578 is engaged in hole 626, coupler 578 is free to pivot about a pivot axis defined by the stem and is free to translate along axis 586 of cross-member 576. Coupler 578 includes a channel 630 which is sized to engage a member of a patient-support apparatus such as members 68 or 70 of surgical table 66. Cross-member 576 includes a relief area 632 formed in lower surface 612 which provides clearance for coupler 578 to pivot and translate. The relationship of cross-member 576 and couplers 578 and 580 allows body-support apparatus 574 to be adjusted to fit patient-support apparatuses of differing widths. Additionally, body-support apparatus 574 may be positioned such that longitudinal axis 586 of cross-member 576 is obtuse relative to one of the members of a patient-support apparatus such as members 68 or 70 of surgical table 66 as shown in FIGS. 2-4.

Cross-member 576 also includes two channels 636 and 638 having t-shaped cross-sections formed in a perimeter surface 634. Channel 636 is positioned on the front side 600 of cross-member 576 and channel 638 is formed in the back side 602 of cross-member 576. Supports 582 and 584 have ribs 640 and 642 which are configured to be received in channels 636 and 638 and are sized to permit supports 582 and 584 to be moved along axis 586 to vary the position of supports 582 and 584 and thereby cushions 594. This permits the adjustment of the size of gap 588 and the offset of bisecting axis 590 from central axis 586.

Mounts 608 and 610 are formed in lower surface 612 of cross-member 576 and extend vertically downward therefrom when body-support apparatus 574 is positioned on surgical table 66 as seen in FIGS. 2-4. Referring again to FIG. 41, connector 614 includes a stem 644 and two flanges 646 and 648 which extend from the sides stem 644 and form a space between flanges 646 and 648 which is sized to engage a main portion 650 of mounts 608 and 610. Mounts 608 and 610 each further include a flange 652 coupled to main portion 650. Flange 652 extends laterally outwardly from main portion 650 to form a lip which engages flanges 646 and 648 of connector 614. Stem 644 extends upwardly to support a portion of head support apparatus 616.

As shown in FIGS. 2-4, mounts 608 and 610 permit an apparatus such as head-support apparatus 616 to be mounted directly to body-support apparatus 574. This permits the head-support apparatus 616 to be positioned relative to the body-support apparatus 574 without being mounted to members 68 and 70. This is useful in situations such as that shown in FIGS. 2-4 where body-support apparatus 574 is adjusted to be positioned at a non-perpendicular orientation to member 68 and 70. The configuration of surgical table 66, body-support apparatuses 574 and head-support 616 in the illustrative embodiment of FIGS. 2-4 is suited for supporting a scoliosis patient in a supine or prone position during surgery. It should be understood that while the mounts 608 and 610 of the illustrative embodiment of FIGS. 40-46 are used to mount head-support apparatus 616, in other embodiments, mounts may be configured to support other surgical accessories and supports such as arm boards, other body-supports or the like.

While several embodiments of body-support apparatuses have been disclosed, it should be noted that any of a number of combinations of various features may be combined to configure a body-support apparatus according to the present invention. For example, FIG. 17 shows a patient 300 in phantom supported in the chest area by a body-support apparatus 654 and in the hip area by a body-support apparatus 656. Body-support apparatus 654 includes a coupler 658 which secures body-support apparatus 654 to members 68 and 70 of surgical table 66. The positioning of a body-support portion 660 is accomplished by a system of hook-and-loop-fasteners 662 which secures body-support portion 660 laterally relative to a frame 664 of body-support apparatus 654. The system of hook-and-loop-fasteners 662 includes a strap 668 sewn to body-support portion 660, loop portion 666 of hook-and-loop-fastener system 662 is coupled on an outboard side of frame 664. A hook portion 670 is coupled to strap 668. Body-support portion 660 is secured laterally by the engagement of hook portion 670 with loop portion 666 which secures body-support portion 660 relative to frame 664.

In yet another embodiment shown in FIG. 18, a body-support apparatus 672 includes two body-support portions 674 and 676 and a frame 678. The lateral position of the body-support portions 674 and 676 is adjusted through systems of hook-and-loop-fasteners 680 and 682. Illustratively, a strap 684 is coupled to an inboard side of body-support portion 674 by sewing. A hook portion 686 of the system 680 is coupled to strap 684. A loop portion 688 of system 680 is coupled to an outboard side of body-support portion 674. Strap 684 is routed under frame 678 and member such that hook portion 686 is engaged with loop portion 688 to secure body-support portion 674 laterally under the load of a patient 300. In the illustrative embodiment of FIG. 18, body-support portion 676 is secured laterally in a manner similar to that of body-support portion 674.

Figure 34:
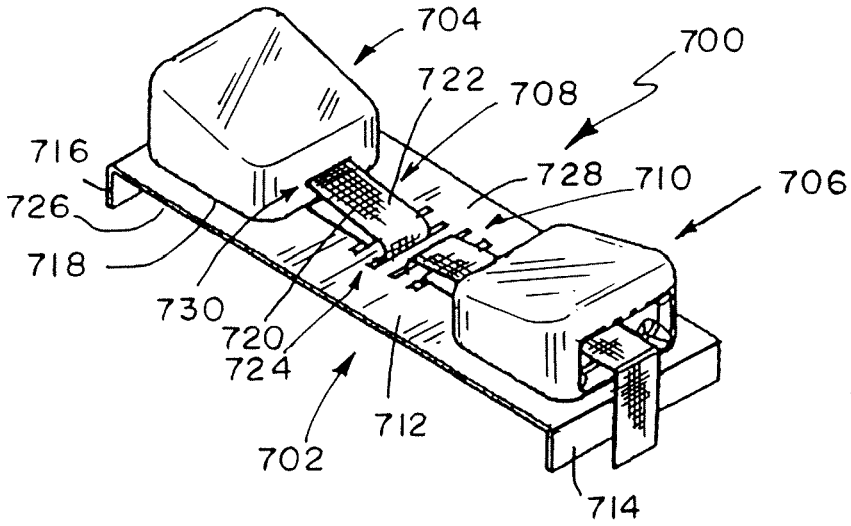
FIG. 34 is a perspective view of yet another body-support apparatus having two body-support portions spaced apart and adjustable to conform to the contours of the body a patient, the body-support portions secured to a support member by a system of hook-and-loop-fasteners.

A simple body-support apparatus 700 is shown in FIG. 34 and comprises a frame 702, body-support portions 704 and 706, and two systems of hook-and-loop-fasteners 708 and 710 securing the body-support portions 704 and 706 relative to frame 702. Frame 702 includes a main portion 712 and two flanges 714 and 716. Flanges 714 and 716 are spaced apart such that frame 702 is configured to be supported on members of a patient-support apparatus such as member 68 and 70 of surgical table 66. Flanges 714 and 716 prevent lateral movement of body-support apparatus 700 relative to surgical table 66. Body-support portion 704 has a generally planar lower surface 718 which is supported on an upper surface 720 of frame 702. Body-support portion 704 further includes a generally planar upper surface which is inclined relative to lower surface 718 such that body-support portion 704 has a greater vertical height at an outward side than an inner side thereby forming a wedge-shaped structure. Body-support portion 706 is symmetrical to body-support portion 704 and each is adjustable relative to frame 702 to change a lateral distance therebetween.

Illustratively, a strap 722 of system 708 is coupled to the bottom surface 718 of body-support portion 704. Strap 722 is routed over surface 720 and into an aperture 724 which communicates to a lower surface 726. Strap 722 is then routed through an aperture 728 back to surface 720 and back upon itself into an aperture in body-support portion 704. Strap 722 is then routed through body-support portion 704 and over the edge of main portion 712. A hook portion (not shown) of a hook-and-loop-fastener is coupled to strap 722 and is engaged with a loop portion (not shown) of a hook-and-loop-fastener which is secured to the outside of flange 716. Body-support portion 704 is thereby secured to frame 702. Adjustment of the position of body-support portion 704 is accomplished by releasing the hook-and-loop-fastener and adjusting the strap to position the body-support portion 704. Body-support portion 706 is adjusted similarly to body-support portion 704. The routing of strap 722 through body-support portions 704 and 704 provides a secure positioning of body-support portions 704 and 706 as the locking of the hook and loop fastening system tends to immobilize the body-support portions 704 and 704 in multiple axes.

Figure 35:
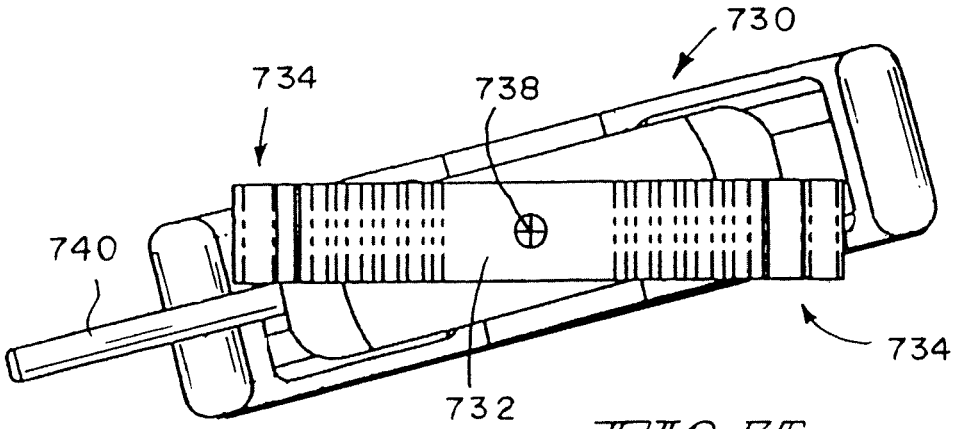
FIG. 35 is a bottom view of yet another embodiment of a body-support apparatus having a unitary body-support portion pivotable relative to a cross-member, the apparatus including a handle extending from the body-support portion to permit adjustment of the orientation of the body-support member relative to the cross-member.
Figure 36:
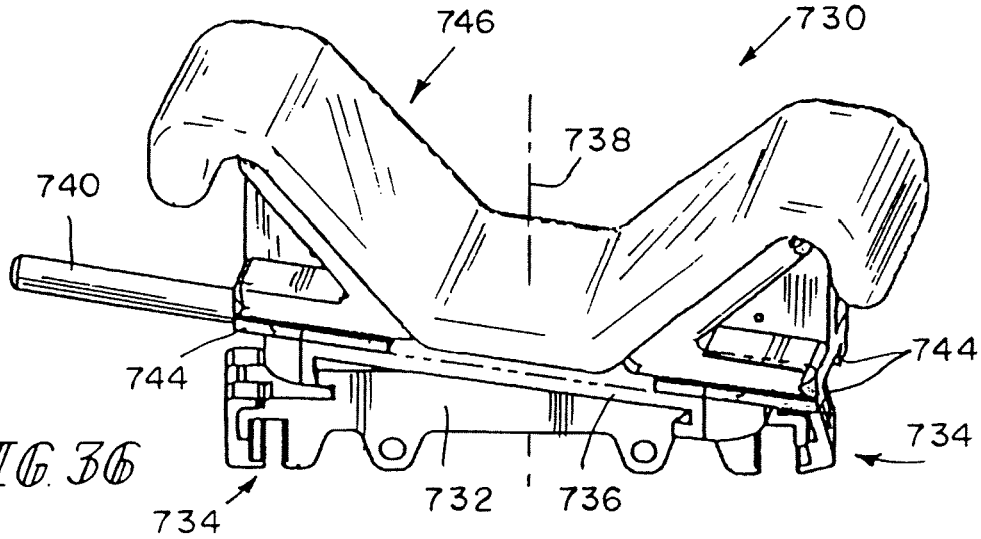
FIG. 36 is a perspective view of the body-support apparatus of FIG. 35.

Referring to FIGS. 35 and 36, another embodiment of body-support apparatus 730, a frame 732 is includes two couplers 734 which are configured to releasably secure frame 732 to members of a patient-support apparatus such as members 68 and 70 of surgical table 66. A cross-member 736 is coupled to frame 732 and is pivotable about a pivot axis 738 relative to frame 732. A handle 740 is coupled to cross-member 736 and extends outwardly therefrom to be accessible while a patient is supported on body-support apparatus 730 to rotate cross-member 736 relative to frame 732.

Body-support apparatus 730 further includes two supports 740 which have t-shaped ribs 742, 744 which engage t-shaped channels (not shown) in cross-member 736. Supports 742 and 744 support a cushion 746. The operation of supports 742 and 744 and cushion 746 is similar to the supports 534 and 536 and cushion 538 of body-support apparatus 532 discussed above.

Frame 732 is thereby fixed to a patient-support apparatus and the upper assembly 748 pivots relative to frame 732 and thereby, the patient-support apparatus. This assists in supporting a patient who needs to have a portion of their spine oriented in a direction that is not parallel to the longitudinal length of the patient-support apparatus. This is especially useful for positioning a patient who suffers from scoliosis in a supine or prone position for spinal surgery.

Figure 38:
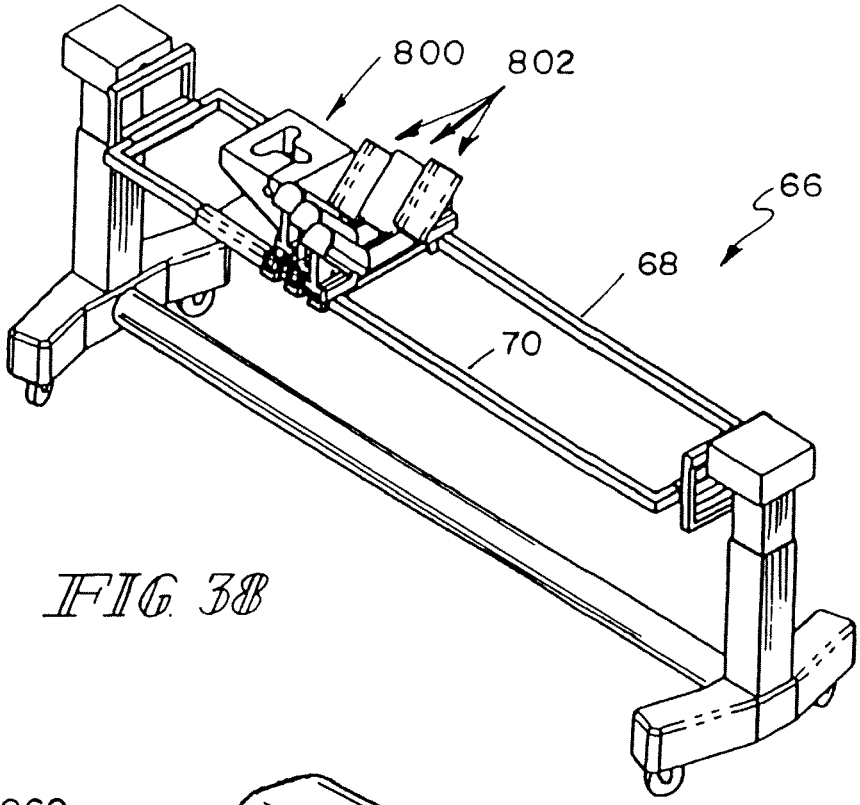
FIG. 38 is a perspective view of a spinal surgical table having two parallel members extending between two extensible posts, the surgical table including the body-supports of FIG. 37 engaged with the parallel members to support the torso of a patient.
Figure 39:
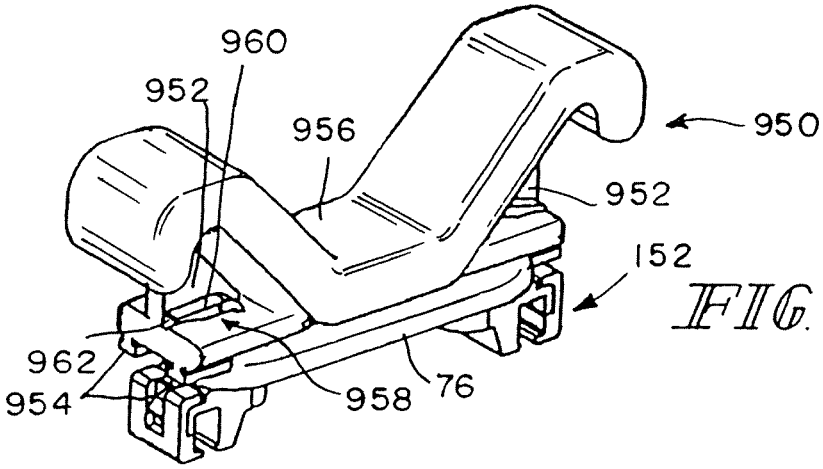
FIG. 39 is a perspective view of yet another embodiment of a body-support apparatus having a unitary body-support portion with spaced apart protrusions.
Figure 40:
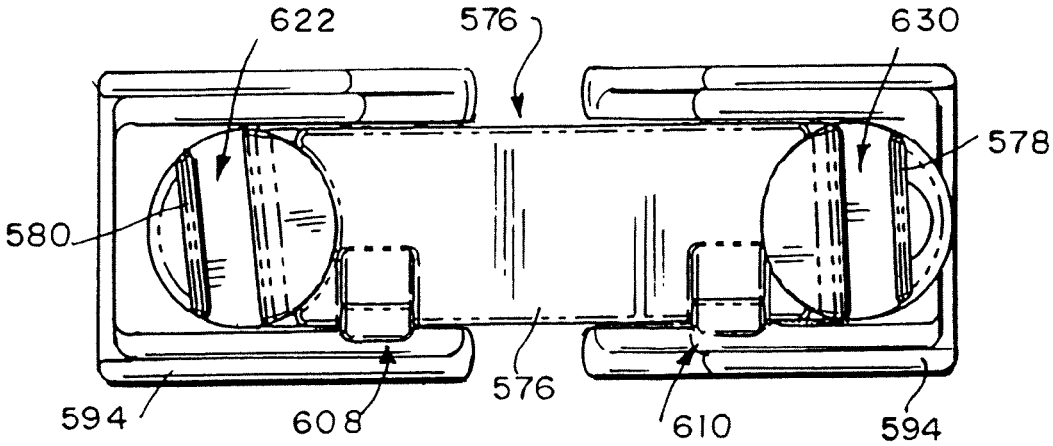
FIG. 40 is a bottom plan view of another embodiment of a body-support apparatus having two adjustable body-support portions moveable along the length of the cross-member of the body-support apparatus to vary the spacing between the body-support portions, the cross-member of the apparatus including mounts configured to receive mounts of another support member such as a head support member.
Figure 41:
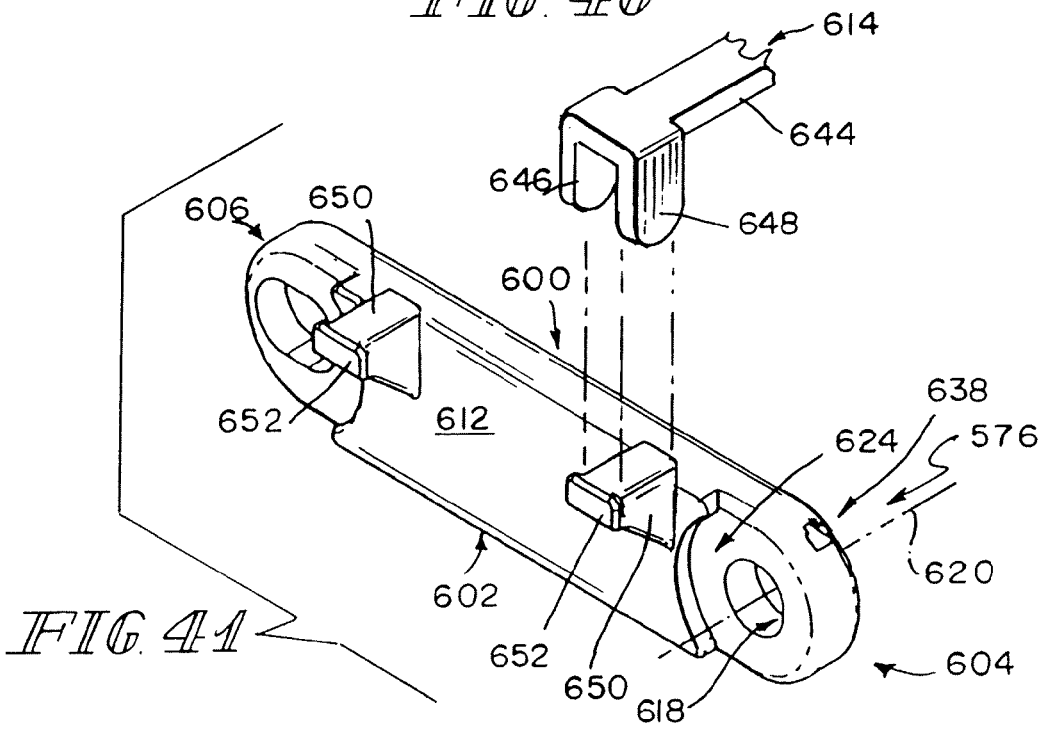
FIG. 41 is a perspective view of the cross-member of the body-support apparatus of FIG. 40.
Figure 42:
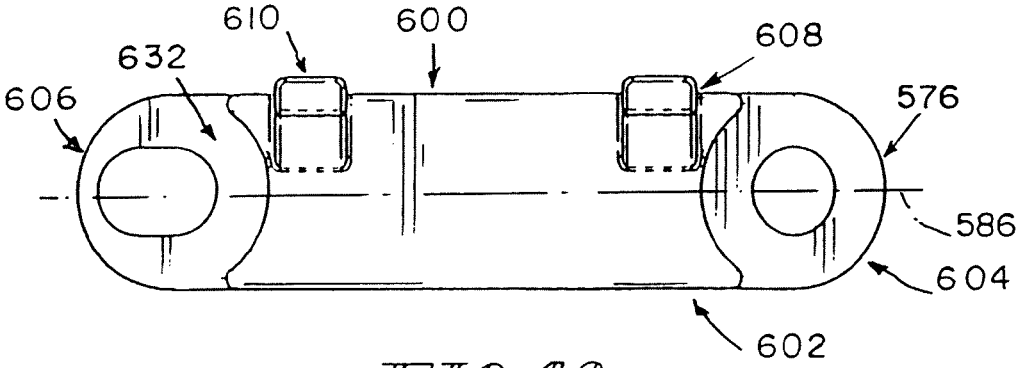
FIG. 42 is a bottom plan view of the cross-member of the body-support apparatus of FIG. 40.
Figure 43:
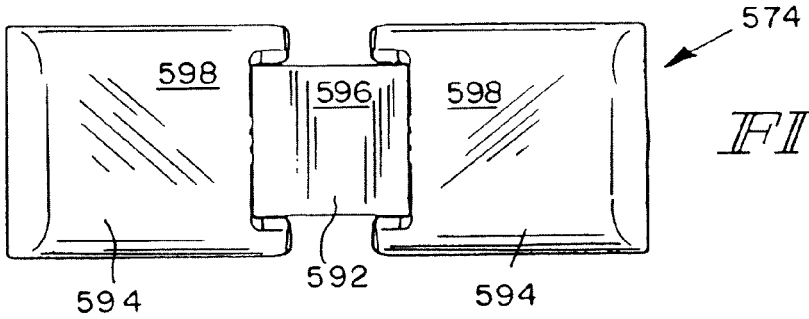
FIG. 43 is a top view of the body-support apparatus of FIG. 40
Figure 44:
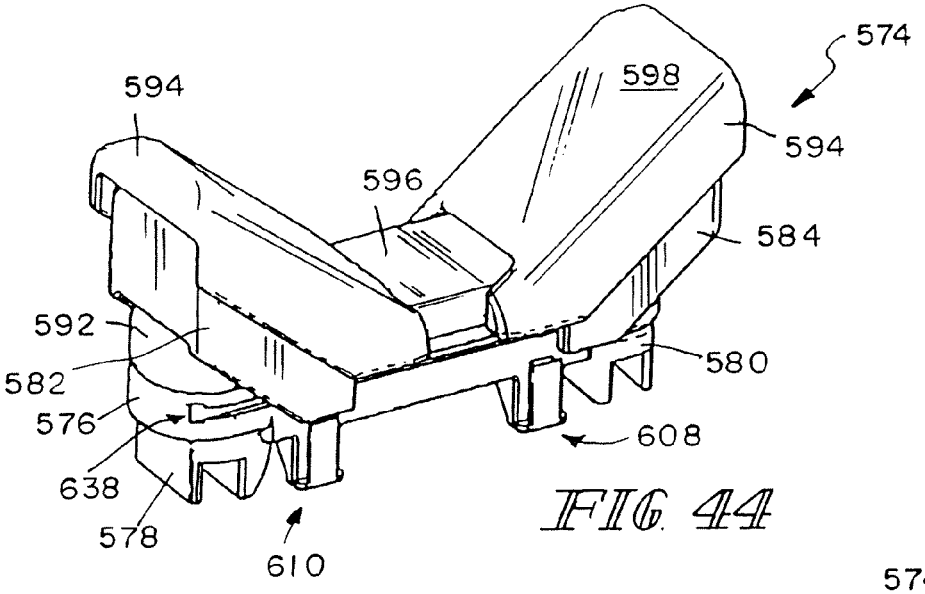
FIG. 44 is a perspective view of the body-support apparatus of FIG. 40.
Figure 45:
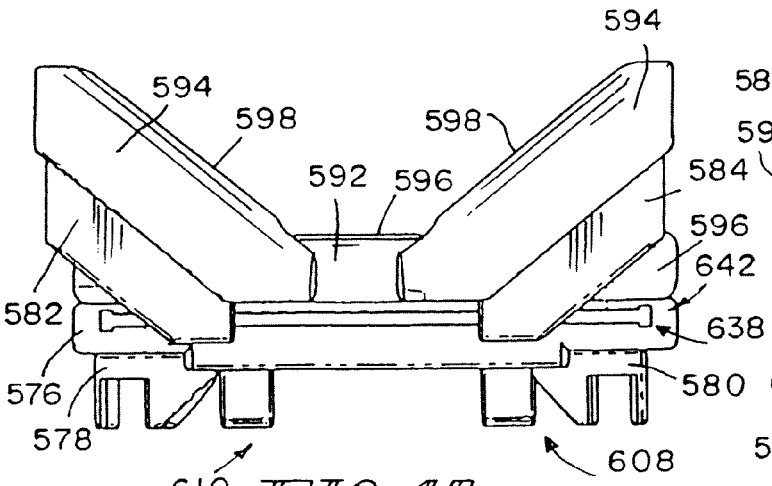
FIG. 45 if a front plan view of the body-support of FIG. 40.
Figure 46:
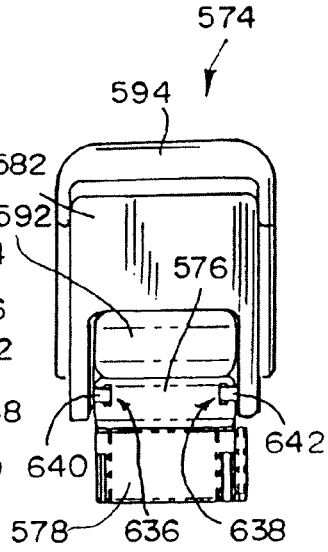
FIG. 46 is a side plan view of the body-support of FIG. 40.

While many of the embodiments of body-support apparatuses have been directed to supporting a patient in a supine or prone position by interfacing with either the chest area or pelvic area of the patient, in some situations, more substantial support is necessary for the patient in the supine or prone position. In FIG. 38, a surgical table 66 is shown with a head-support apparatus 800, and three body-support apparatuses 802 mounted on members 68 and 70. Body-support apparatus 802 is configured to provide support to a patient in a supine or prone position at multiple points along the length of the patient's body.

Figure 37:
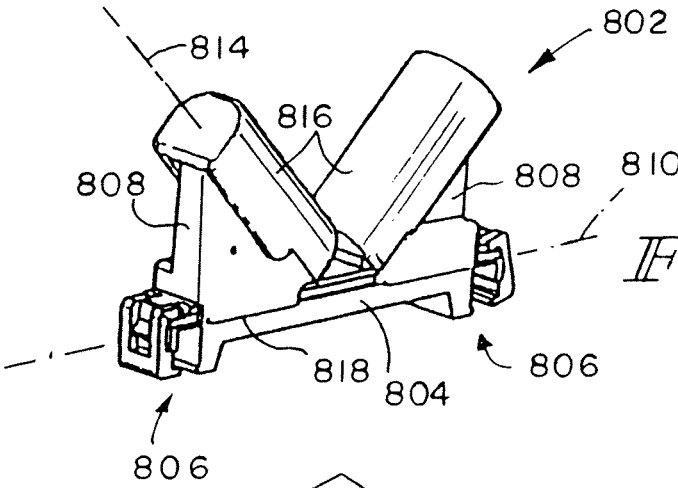
FIG. 37 is a perspective view of still yet another embodiment of a body-support apparatus, the apparatus having two spaced apart body-support portions moveable along the length of a cross-member to vary the spacing between the body-support portions.

As shown in FIG. 37, body-support apparatus 802 includes a frame 804, two couplers 806 coupled to frame 804, two supports 808 engaged with the frame and configured to move along a longitudinal axis 810 of frame 804. Each support 808 supports a body-support portion 812. Body-support portion 812 has a semi-circular cross-section when viewed along an axis 814 of body-support portion 812. The semi-circular cross-section is defined by a rounded outer surface 816 which extends along the length of body-support portion 812. Surface 816 minimizes the area of contact with a patient's body. Body-support portion 812 comprises polyethylene roto-molded to shape.

Couplers 806 are embodied as clamps in the illustrative embodiment of FIGS. 37 and 38. When couplers 806 are in a closed position, they are positioned such that channels formed in the bottom surface 818 of support 808 engage the top of couplers 806 to extend over the coupler and coupler acts as an extension of frame 804. This is illustrated in the three body-support apparatuses 802 shown in FIG. 38. The supports 808 of apparatus 804 closest to the head-support apparatus 800 are positioned such that the supports 808 do not engage couplers 806. The supports 808 of apparatus 804 furthest from head-support apparatus 800 are positioned such that they are fully engaged with the couplers 806 and extend beyond the couplers 806.

In still yet another embodiment, a body-support apparatus 950 comprises a support assembly 152, two supports 952, and a cushion 956. Supports 952 each have an aperture 958 which is sized to receive a spring-loaded latch 960 coupled to cross-member 76 of support assembly 152. Supports 952 also include t-shaped ribs 954 which engage channels 154 and 156 of cross-member 76. Thus, supports 952 may be locked into position when latch 960 engages aperture 958 and the supports 952 held in place until released by activating latch 960. Latch 960 has a body 962 which is shaped to allow latch 960 to be released and removed.

Several embodiments of body-support portions have been disclosed. It should be understood that in all embodiments, a body-support portion may further include a cushion or cushion assembly covering the body-support portion, the cushion or cushion assembly comprising one or more cushioning materials to conform to the contours of a patient supported on the body-support apparatus and to distribute the load of the patient. An illustrative embodiment of a cushion assembly is discussed in the description of FIGS. 8 and 9.

Figure 48:
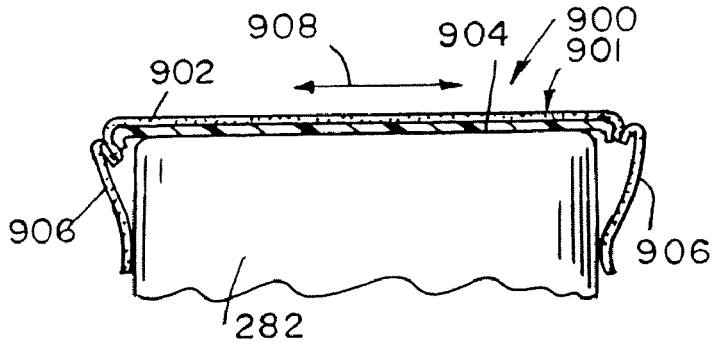
FIG. 48 is a cross-sectional view of the sanitary cover of FIG. 47.
Figure 47:
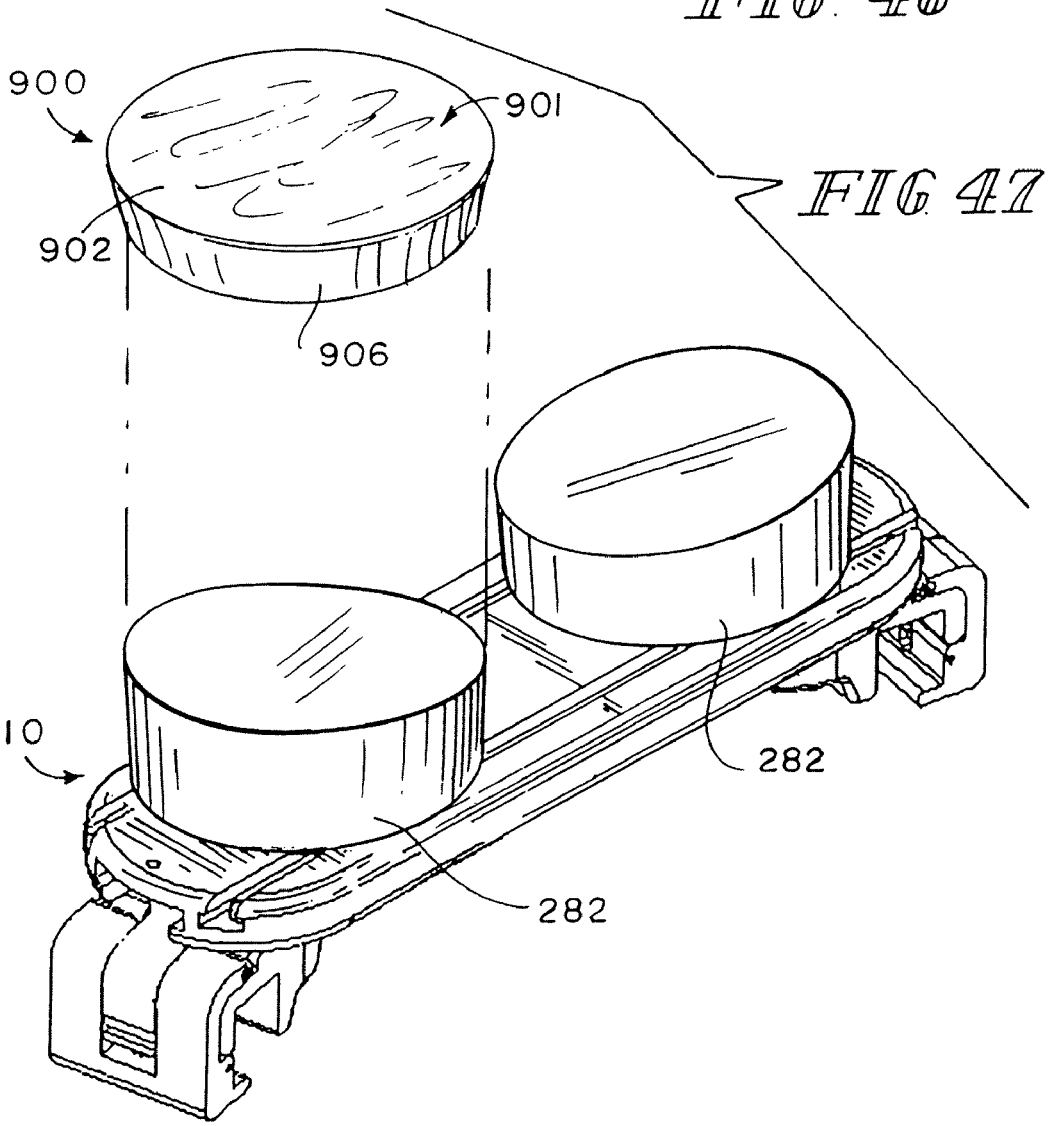
FIG. 47 is an exploded perspective view of a body-support apparatus and a sanitary cover configured to cover the body-support portions of the body-support apparatus.

A cover assembly 900 shown in FIGS. 47 and 48 has a main portion 901 comprises a foam upper layer 902 and a low friction inner layer 904. Upper layer 902 is a super soft water based polyurethane foam. Inner layer 904 comprises a polyethylene fiber based fabric known as Tyvek® which has a very low coefficient of friction. Cover assembly 900 further comprises a retainer 906 which is coupled about the perimeter of upper layer 902. Retainer 906 also comprises super soft water based polyurethane foam which has resilient characteristics which allow the material to be stretched over a cushion assembly such as cushion assembly 282 shown in FIG. 47 coupled to body-support portions 78 and 80 of body-support apparatus 10. Retainer 906 maintains cover assembly 900 in place while a patient is positioned on body-support apparatus 10.

Upper layer 902 distributes the load of a patient supported on a cover assembly 900. In addition, the low-friction layer 904 assists in the adjustment permits the cover assembly 900 to slide as a patient is positioned such that no shear forces are developed between a body-support portion or cushion assembly. Layer 904 slides freely across a cover 284 of cover assembly 282 as depicted by arrow 908.

While the illustrative embodiment of FIGS. 47 and 48 includes water based polyurethane foam secured to an inner low-friction layer comprising Tyvek®, it should be understood that any of a number of combinations of materials may be used. In some embodiments, the upper layer 902 may comprise foam such as polyether polyurethane foam. In still other embodiments, upper layer 902 may comprise polyester based flexible polyurethane foam. Likewise, inner layer 904 may comprise any of a number of materials which comprises a low friction surface which allows cover assembly 900 to move with relative ease as a patient is positioned.

Although certain illustrative embodiments have been described in detail above, variations and modifications exist within the scope and spirit of this disclosure as described and as defined in the following claims.

The invention claimed is:

1. A body support apparatus for use with a spinal surgery frame having a pair of frame members that are spaced apart and parallel, the body support apparatus comprising a support that rests atop the frame members of the spinal surgery frame and that spans the space between the frame members, the support having at least one strap-receiving space defined therein, the support having an overall longitudinal dimension and an overall lateral dimension that is smaller than the overall longitudinal dimension, and at least one body support cushion assembly coupled to the support, the body support cushion assembly having a body support cushion and at least one strap fastened to a first location of the at least one body support cushion, the strap being configured for routing through the strap-receiving space of the support and beneath at least one frame member of the pair of frame members of the spinal surgery frame to couple to a second location of the at least one body support cushion thereby to retain the support and body support cushion in place relative to the spinal surgery frame, the strap extending substantially parallel with the overall lateral dimension of the support and substantially perpendicular to the overall longitudinal dimension of the support when retaining the support and body support cushion in place relative to the spinal surgery frame.

2. The body support apparatus of claim 1, wherein the at least one strap-receiving space is positioned about midway between the frame members.

3. The body support apparatus of claim 1, wherein the at least one strap-receiving space comprises a first aperture and a second aperture, each of the first and second apertures being located about midway between the frame members.

4. The body support apparatus of claim 1, wherein the support comprises a planar panel that rests atop the frame members of the spinal surgery frame.

5. The body support apparatus of claim 4, wherein the at least one strap-receiving opening comprises an aperture formed in the planar panel.

6. The body support apparatus of claim 5, wherein the at least one body support cushion assembly comprises a first body support cushion assembly and a second body support cushion assembly, the first body support cushion assembly having a first body support cushion and a first strap coupled to the first body support cushion, the second body support cushion assembly having a second body support cushion and a second strap coupled to the second body support cushion, and the aperture receives both the first and second strap therein.

7. The body support apparatus of claim 4, wherein the at least one strap-receiving opening comprises a first aperture formed in the planar panel and a second aperture formed in the planar panel.

8. The body support apparatus of claim 7, wherein the at least one body support cushion assembly comprises a first body support cushion assembly and a second body support cushion assembly, the first body support cushion assembly having a first body support cushion and first and second straps coupled to the first body support cushion, the second body support cushion assembly having a second body support cushion and third and fourth straps coupled to the second body support cushion, the first aperture receives the first and third straps therein, and the second aperture receives the second and fourth straps therein.

9. The body support apparatus of claim 1, wherein the at least one strap-receiving opening comprises an aperture formed in the support.

10. The body support apparatus of claim 9, wherein the at least one body support cushion assembly comprises a first body support cushion assembly and a second body support cushion assembly, the first body support cushion assembly having a first body support cushion and a first strap coupled to the first body support cushion, the second body support cushion assembly having a second body support cushion and a second strap coupled to the second body support cushion, and the aperture receives both the first and second strap therein.

11. The body support apparatus of claim 1, wherein the at least one strap-receiving opening comprises a first aperture formed in the support and a second aperture formed in the support.

12. The body support apparatus of claim 1, wherein the at least one body support cushion assembly comprises a first body support cushion assembly and a second body support cushion assembly, the first body support cushion assembly having a first body support cushion and first and second straps coupled to the first body support cushion, the second body support cushion assembly having a second body support cushion and third and fourth straps coupled to the second body support cushion, the first aperture receives the first and third straps therein, and the second aperture receives the second and fourth straps therein.

13. The body support apparatus of claim 1, wherein the at least one strap couples to the second location of the at least one body support cushion via a hook and loop fastener.

14. The body support apparatus of claim 1, wherein the at least one strap comprises a first strap and a second strap, the first and second straps couple to respective second locations of the at least one body support cushion via respective a hook and loop fasteners.

15. The body support apparatus of claim 1, wherein the at least one body support cushion comprises a pair of arched portions having convex upwardly facing surfaces configured to support an upper thoracic region of a patient.

16. The body support apparatus of claim 15, wherein the at least on body support cushion comprises a central portion that interconnects the pair of arched portions.

17. The body support apparatus of claim 15, wherein the convex upwardly facing surfaces of each of the arched portions are inclined inwardly toward a central region of the body support apparatus.

18. The body support apparatus of claim 15, wherein the at least one strap comprises a first pair of straps coupled to a first arched portion of the pair of arched portions and a second pair of straps coupled to a second arched portion of the pair of arched portions, the first pair of straps being configured to permit the first arched portion to be retained on the support in a first orientation that is parallel with the frame members of the spinal surgery frame, the first pair of straps being configured to permit the first arched portion to be retained on the support in a second orientation that is non-parallel with the frame members of the spinal surgery frame, the second pair of straps being configured to permit the second arched portion to be retained on the support in a third orientation that is parallel with the frame members of the spinal surgery frame, and the second pair of straps being configured to permit the second arched portion to be retained on the support in a fourth orientation that is non-parallel with the frame members of the spinal surgery frame.

19. The body support apparatus of claim 1, wherein the support body support cushion comprises an arched portion having a convex upwardly facing surface that inclines inwardly toward a central region of the body support apparatus.

20. The body support apparatus of claim 1, wherein the support comprises a main portion that rests atop the frame members of the spinal surgery frame and a pair of flanges that extend downwardly from the main portion at locations outboard of the frame members of the spinal surgery frame.

21. A body support apparatus for use with a spinal surgery frame having a pair of frame members that are spaced apart and parallel, the body support apparatus comprising a support that rests atop the frame members of the spinal surgery frame and that spans the space between the frame members, the support having at least one strap-receiving space defined therein, and at least one body support cushion assembly coupled to the support, the body support cushion assembly having a body support cushion and at least one strap fastened to a first location of the at least one body support cushion, the strap being configured for routing through the strap-receiving space of the support and beneath at least one frame member of the pair of frame members of the spinal surgery frame to couple to a second location of the at least one body support cushion thereby to retain the support and body support cushion in place relative to the spinal surgery frame, wherein the at least one body support cushion comprises a pair of arched portions having convex upwardly facing surfaces configured to support an upper thoracic region of a patient, wherein the at least one strap comprises a first pair of straps coupled to a first arched portion of the pair of arched portions and a second pair of straps coupled to a second arched portion of the pair of arched portions, the first pair of straps being configured to permit the first arched portion to be retained on the support in a first orientation that is parallel with the frame members of the spinal surgery frame, the first pair of straps being configured to permit the first arched portion to be retained on the support in a second orientation that is non-parallel with the frame members of the spinal surgery frame, the second pair of straps being configured to permit the second arched portion to be retained on the support in a third orientation that is parallel with the frame members of the spinal surgery frame, and the second pair of straps being configured to permit the second arched portion to be retained on the support in a fourth orientation that is non-parallel with the frame members of the spinal surgery frame.

* * * * *